US010839783B2

(12) United States Patent
Becker

(10) Patent No.: US 10,839,783 B2
(45) Date of Patent: Nov. 17, 2020

(54) AUTOMATED SINGING BOWL

(71) Applicant: Randolph Sean Becker, Houston, TX (US)

(72) Inventor: Randolph Sean Becker, Houston, TX (US)

( * ) Notice: Subject to any disclaimer, the term of this patent is extended or adjusted under 35 U.S.C. 154(b) by 0 days.

(21) Appl. No.: 16/520,144

(22) Filed: Jul. 23, 2019

(65) Prior Publication Data

US 2020/0027434 A1 Jan. 23, 2020

Related U.S. Application Data

(60) Provisional application No. 62/702,303, filed on Jul. 23, 2018.

(51) Int. Cl.
*G10K 1/072* (2006.01)
*G10G 5/00* (2006.01)

(52) U.S. Cl.
CPC ..... *G10K 1/072* (2013.01); *G10G 5/00* (2013.01)

(58) Field of Classification Search
CPC ..... G10K 1/072; G10G 5/00
See application file for complete search history.

(56) References Cited

U.S. PATENT DOCUMENTS

2009/0178537 A1* 7/2009 Kerns ..... G10D 13/08 84/411 R

OTHER PUBLICATIONS https://www.youtube.com/watch?v=dggf7y0Guhs&feature=youtu.be; Chaerin Son. Apr. 15, 2016; Entire video (Year: 2016).*
Printout: https://www.youtube.com/watch?v=dggf7y0Guhs&feature=youtu.be; Chaerin Son. Apr. 15, 2016; Entire video (Year: 2016).*

* cited by examiner

*Primary Examiner* — Kimberly R Lockett
(74) *Attorney, Agent, or Firm* — Shannon Warren

(57) ABSTRACT

A singing bowl player for selectively striking, turning and playing a bowl. The singing bowl player comprises a central axis, a mallet assembly, a rotating layer, and a base. The base supports the singing bowl player. The mallet assembly attaches to the rotating layer. The rotating layer is configured to rotate about the central axis relative to the base in a 360-degree pattern. The base supports and secures the bowl. The mallet assembly comprises a mallet having a striking tip. The mallet assembly selectively holds the striking tip of the mallet at a rim of the bowl as the rotating layer rotates the striking tip around the rim.

17 Claims, 38 Drawing Sheets

ALTERNATIVE EMBODIMENT

ALTERNATIVE EMBODIMENT

ALTERNATIVE EMBODIMENT

ALTERNATIVE EMBODIMENT

AUTOMATED SINGING BOWL

CROSS-REFERENCE TO RELATED APPLICATIONS

This application claims benefit to U.S. Patent Application No. 62/702,303 filed on Jul. 23, 2018.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

A singing bowl player for selectively striking, turning and playing a bowl. Said singing bowl player comprises a central axis, a mallet assembly, a rotating layer, and a base. Said base supports said singing bowl player. Said mallet assembly attaches to said rotating layer. Said rotating layer is configured to rotate about said central axis relative to said base in a 360-degree pattern. Said base supports and secures said bowl. Said mallet assembly comprises a mallet having a striking tip. Said mallet assembly selectively holds said striking tip of said mallet at a rim of said bowl as said rotating layer rotates said striking tip around said rim.

A singing bowl player for selectively striking, turning and playing said bowl. Said singing bowl player comprises a base assembly, a vertical assembly, a neck assembly, a horizontal assembly, a striker adjustment assembly, and a bowl seat. Said base assembly supports said singing bowl player. Said vertical assembly connects said base assembly to said neck assembly. Said neck assembly connects said vertical assembly to said horizontal assembly. Said striker adjustment assembly is attached to a portion of 108. Said neck assembly comprises variable height. Said horizontal assembly comprises a variable radius. Said striker adjustment assembly comprises striker. Said striker comprises a tip. Said singing bowl player is configured to place said tip at a striking circumference. Said striking circumference comprises said variable radius and a variable height. Said singing bowl player comprises a rotary motor assembly for turning said horizontal assembly. turning said horizontal assembly causes said tip to rotate through said striking circumference. Said bowl seat holds a portion of said bowl.

DETAILED DESCRIPTION OF THE INVENTION

Figure 1A:
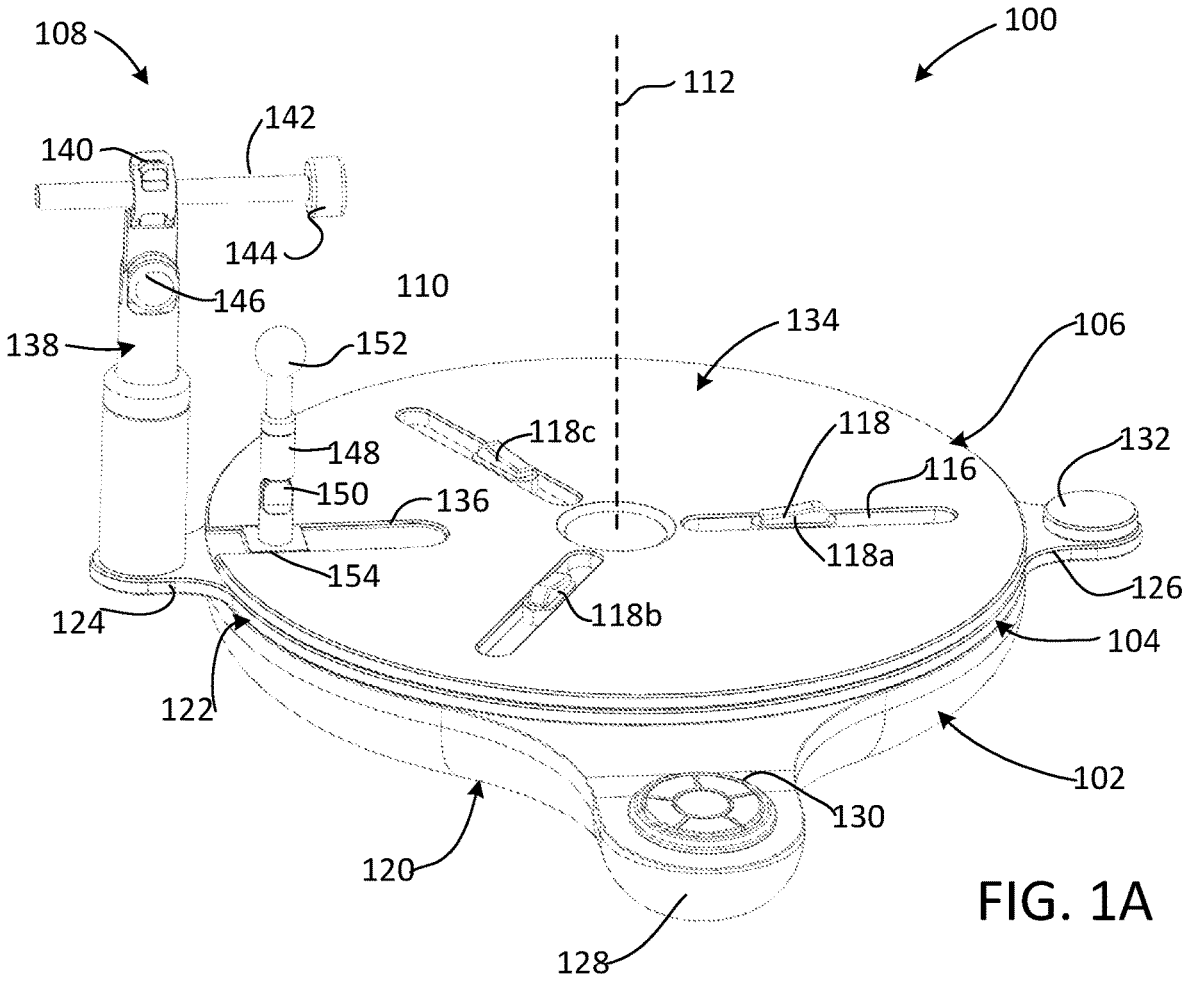
FIGS. 1A and 1B illustrate a perspective overview of a singing bowl player 100 with and without a bowl 114.
Figure 1B:
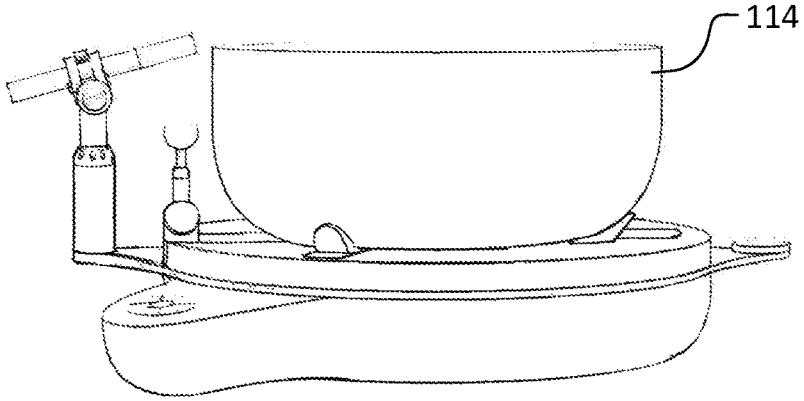

FIGS. 1A and 1B illustrate a perspective overview of a singing bowl player 100 with and without a bowl 114.

In one embodiment, said singing bowl player 100 can comprise a base 102, a rotating layer 104, a top plate 106, a mallet assembly 108, and an intermittent striker assembly 110.

Said base 102 can comprise a bottom surface 120 configured to securely hold said singing bowl player 100 on a surface such as a table or the floor. In one embodiment, said base 102 can comprise a substantially cylindrical body having a controls extension 128 out to one side to display a controls panel 130.

Said rotating layer 104 is configured to rotate about a central axis 112 relative to said base 102 in a 360-degree pattern. In one embodiment, said rotating layer 104 can comprise a substantially round plate 122 with a first extension 124 and a second extension 126. In one embodiment, said first extension 124 can support said mallet assembly 108; and said second extension 126 can support a counterweight 132.

Said top plate 106 is configured to support said bowl 114 (discussed below). In one embodiment, said singing bowl player 100 can be configured to be operational without said top plate 106 provided said bowl 114 can be supported in part by said base 102. In one embodiment, said top plate 106 can comprise a plurality of support slots 116 and a plurality of bowl supports 118. Said singing bowl player 100 and said top plate 106 can comprise a top surface 134, as illustrated. In one embodiment, said top plate 106 can comprise an intermittent striker slot 136. In one embodiment, said intermittent striker assembly 110, as well as said plurality of bowl supports 118 can slide in and out relative to said central axis 112 within said intermittent striker slot 136 and said plurality of support slots 116, respectively.

Said plurality of support slots 116 can comprise a third support slot 116*c*, a second support slot 116*b*, and a first support slot 116*a*. Said plurality of bowl supports 118 can comprise a third bowl support 118*c*, a second bowl support 118*b*, and a first bowl support 118*a*.

In one embodiment, said mallet assembly 108 can comprise a vertical mallet support assembly 138, a clip portion 140, and a mallet 142 with a striking tip 144. In one embodiment, said vertical mallet support assembly 138 can comprise an adjusting hinge 146.

In one embodiment, said intermittent striker assembly 110 can comprise a vertical striker support assembly 148 with a hinge 150, a striking tip 152, and a base 154.

Figure 2:
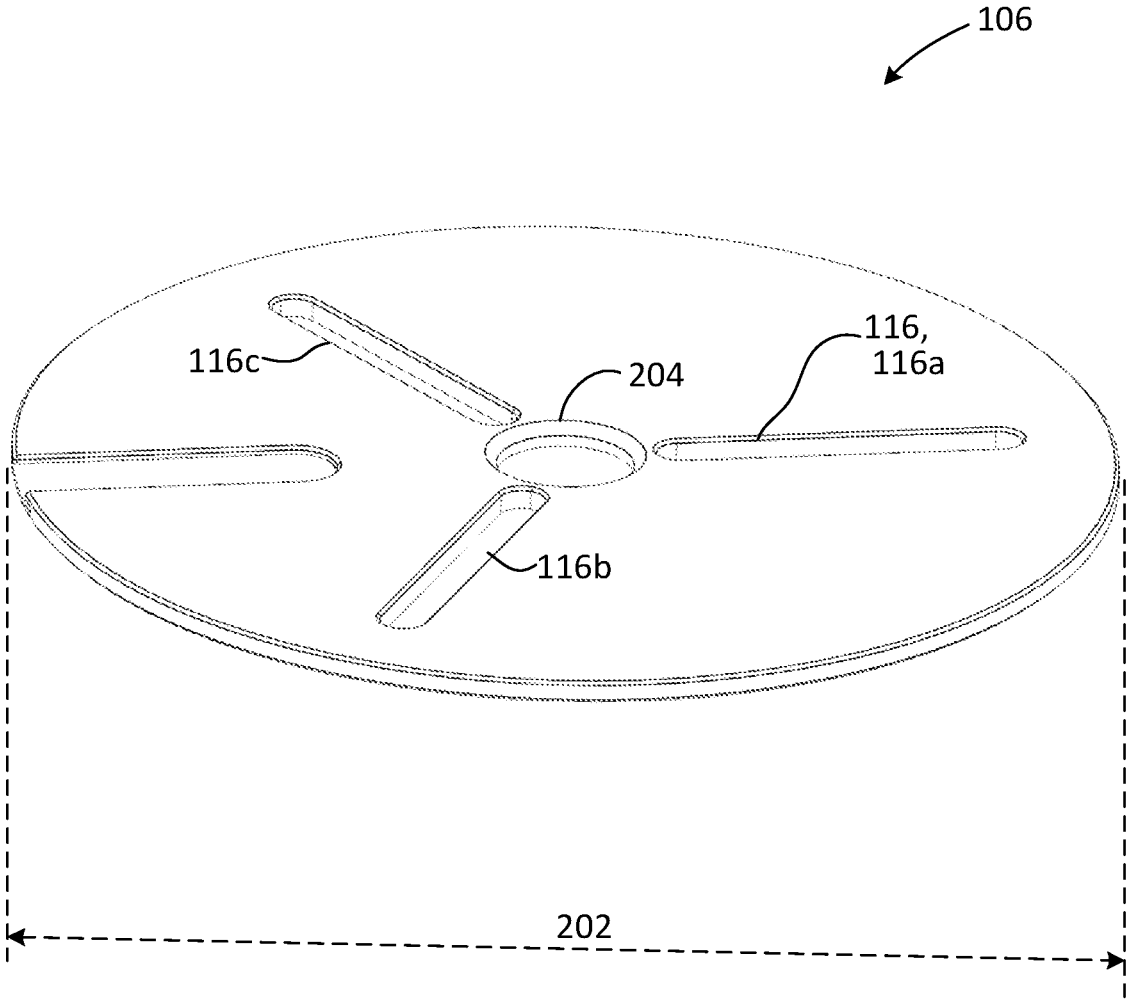
FIG. 2 illustrates a perspective overview of a top plate 106.

FIG. 2 illustrates a perspective overview of said top plate 106.

In one embodiment, said top plate 106 can comprise a top plate diameter 202 and a top plate central aperture 204. In one embodiment, said top plate central aperture 204 can be used to selectively attach said top plate 106 to said rotating layer 104, and said base 102, details of the attachment means are omitted in this rendering. See drive assembly 2502, as illustrated and discussed below.

Figure 3:
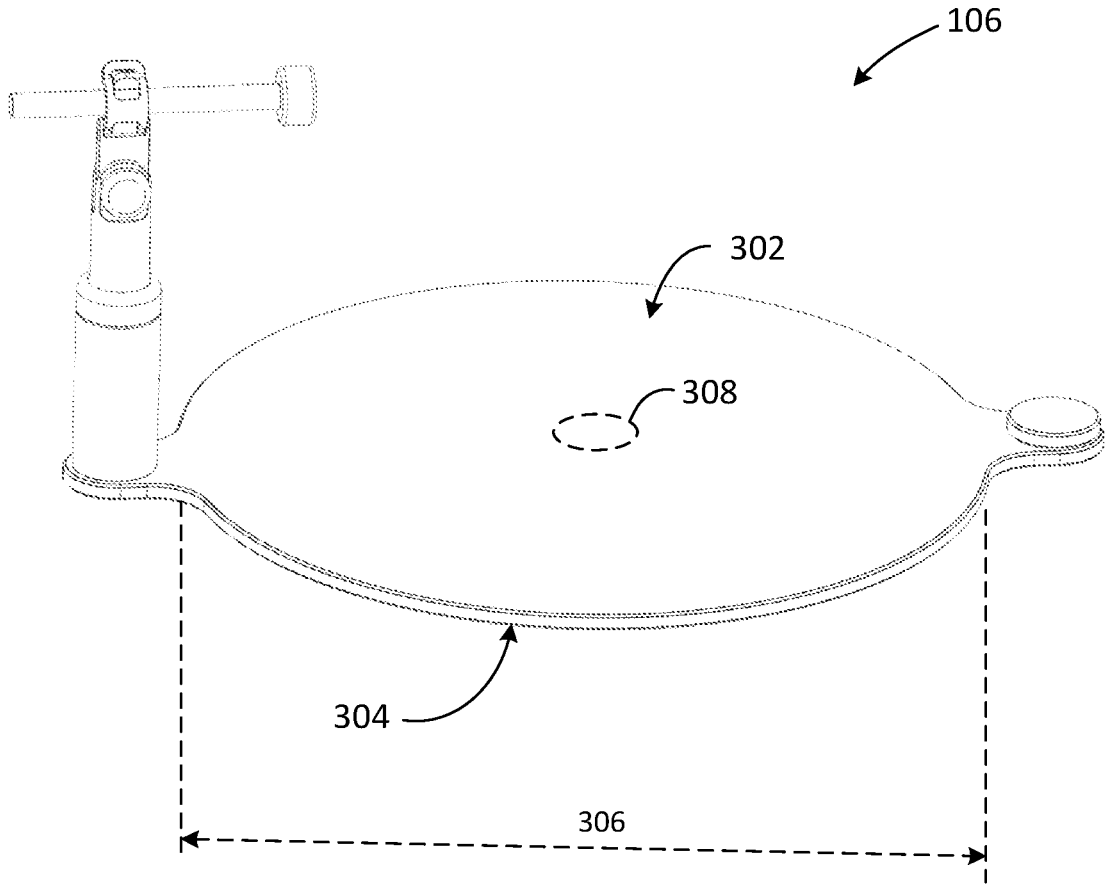
FIG. 3 a perspective overview of a rotating layer 104 with a counterweight 132, and a mallet assembly 108.

FIG. 3 a perspective overview of said rotating layer 104 with said counterweight 132, and said mallet assembly 108.

In one embodiment, said substantially round plate 122 can comprise a top surface 302, a bottom surface 304, and a middle plate diameter 306. In one embodiment, said middle plate diameter 306, and said top plate diameter 202 can be substantially the same.

Said rotating layer 104 can further comprise a drive system placeholder 308 which is to be replaced and embellished with said drive assembly 2502 to be discussed in more detail below. One purpose of said drive assembly 2502 is to transmit a rotary drive force into said middle plate diameter 306.

Figure 4:
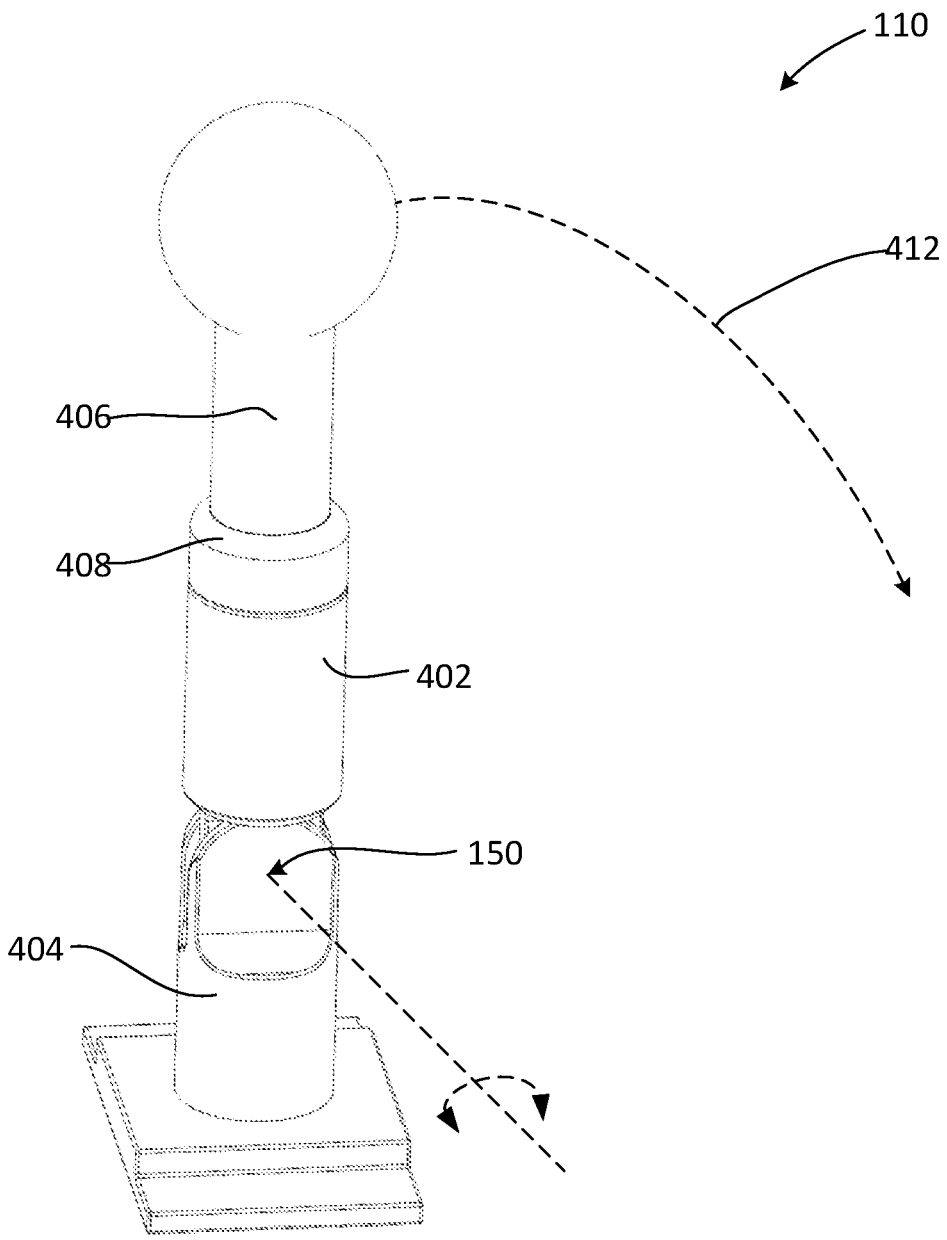
FIG. 4 a perspective overview of an intermittent striker assembly 110.

FIG. 4 a perspective overview of said intermittent striker assembly 110.

In one embodiment, said vertical striker support assembly 148 can be divided between an upper portion 402 and a lower portion 404 by said hinge 150. Said upper portion 402 can further be adjustably attached to a mallet extension 406 with a tightening grip 408. Said mallet extension 406, in turn can be attached to said striking tip 152.

In one embodiment, said hinge 150 can be electronically engaged to selectively strike said bowl 114, as discussed below. However, said hinge 150 can comprise an intermediate striker servo motor 410 which is not illustrated here but well-known in the art. Said striking tip 152 can be selectively engaged to strike said bowl 114 with said intermediate striker servo motor 410 along a striking path 412 defined by a circular path rotating around said hinge 150, as illustrated.

Figure 5A:
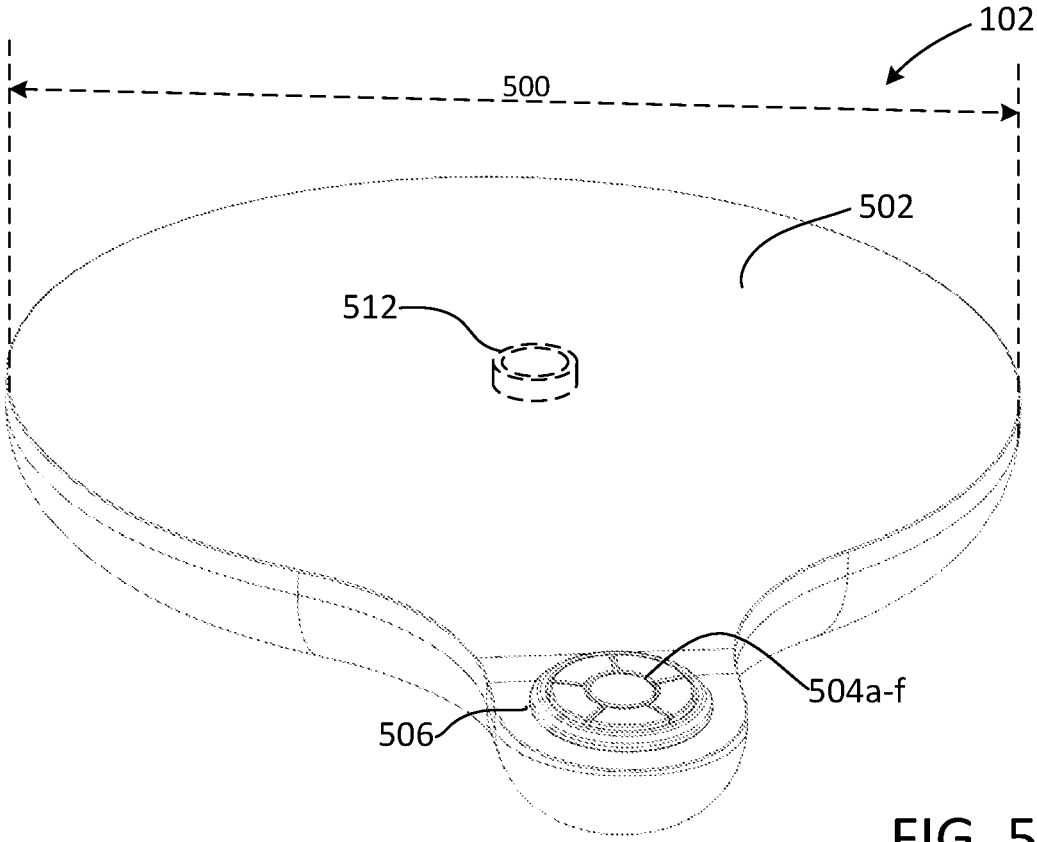
FIGS. 5A and 5B illustrate a perspective overview and lower view of a base 102.
Figure 5B:
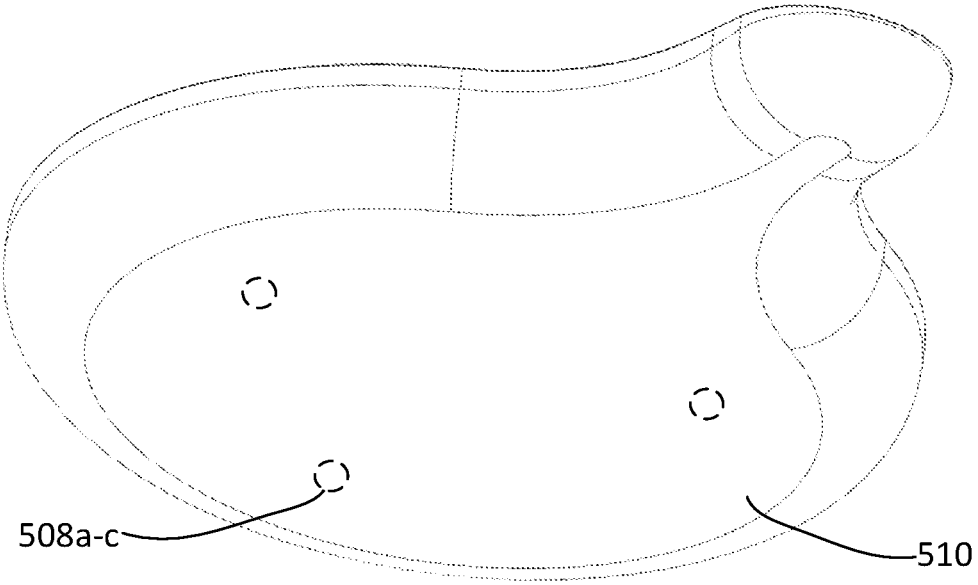

FIGS. 5A and 5B illustrate a perspective overview and lower view of said base 102.

In one embodiment, said base 102 can comprise a base diameter 500, and a top surface 502. Said controls panel 130 can comprise a one or more buttons 504 (such as fifth button 504*e*, fourth button 504*d*, third button 504*c*, second button 504*b*, and first button 504*a*), and a rotary input 506.

In one embodiment, said bottom surface 120 of said base 102 can comprise a plurality of feet 508 (such as a first foot 508*a*, a second foot 508*b*, and a third foot 508*c*); and/or a rubber bottom surface 510.

Said base 102 can further comprise a lower drive system placeholder 512 comprising a means to attach to and hold said top plate 106 and attach to and rotate said rotating layer 104. More on this topic can be found at the illustration and discussion of said drive assembly 2502.

Figure 6A:
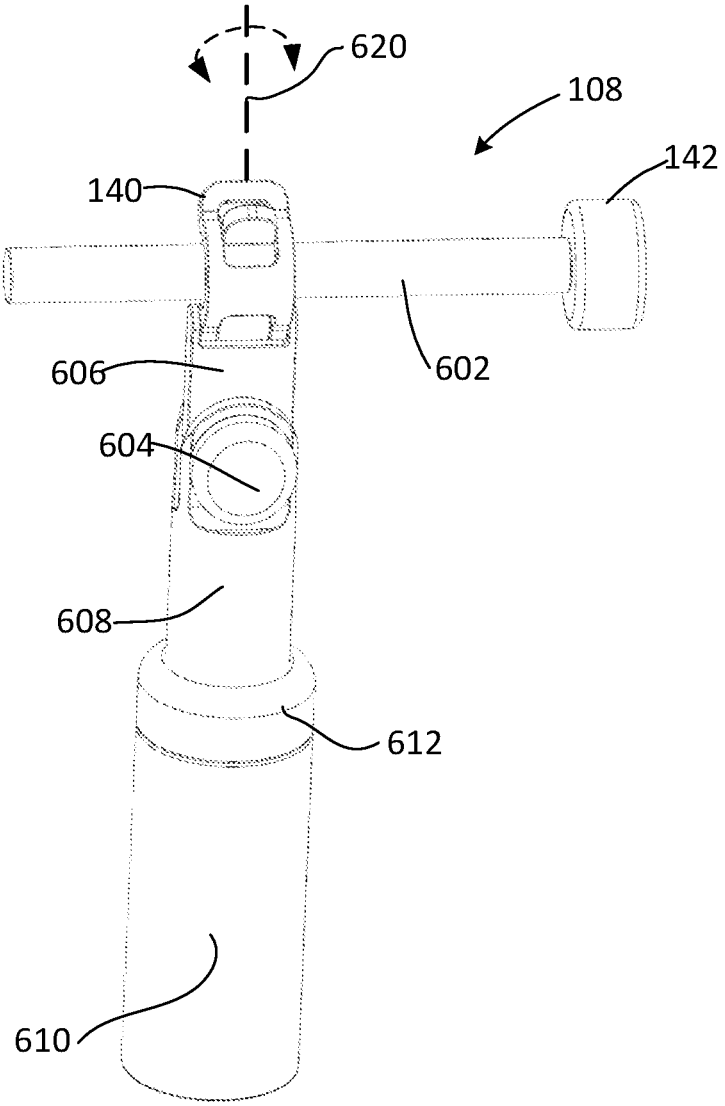
FIGS. 6A, 6B and 6C illustrate a perspective overview and two detailed views of said mallet assembly 108.
Figure 6B:
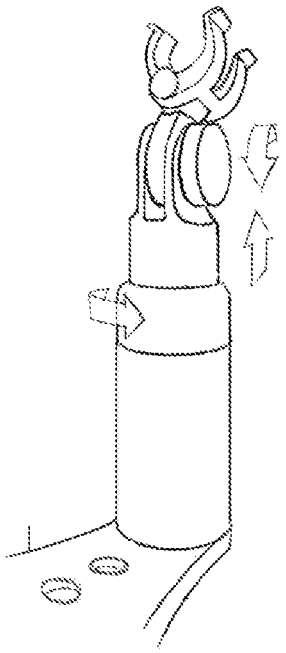
Figure 6C:
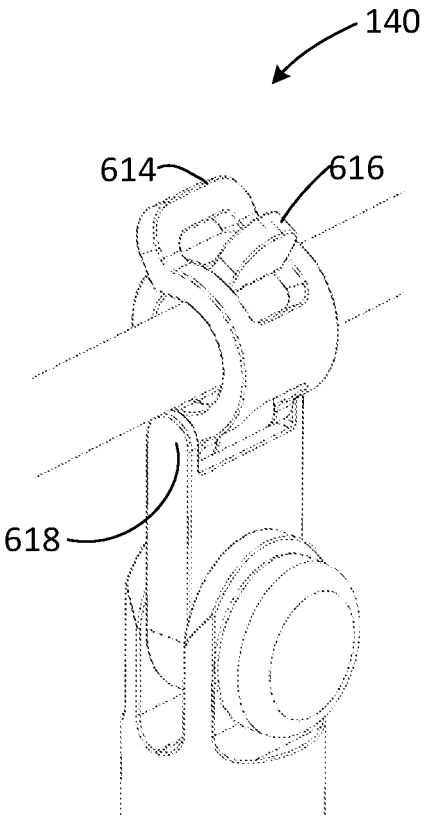

FIGS. 6A, 6B and 6C illustrate a perspective overview and two detailed views of said mallet assembly 108.

In one embodiment, said mallet assembly 108 can said mallet 142 having a handle 602 and said striking tip 144, said adjusting hinge 146 having a tightening knob 604, said vertical mallet support assembly 138 having an upper portion 606, a lower portion 608, a lower sleeve 610 and a sleeve tightener 612, said clip portion 140 having a first side 614 and a second side 616. In one embodiment, said clip portion 140 can be rotateably attached to said upper portion 606 along a clip hinge 618. In one embodiment, said tightening knob 604 can control a tilt of said mallet assembly 108. In one embodiment, said sleeve tightener 612 can control and adjust a rotary position of said upper portion 606 as well as a height of said clip hinge 618 relative to said lower sleeve 610.

In one embodiment, said mallet assembly 108 can be selectively rotated about a mallet axis 620 by a mallet servo motor 622 (illustrated here in dashed lines), as is known in the art.

Figure 7:
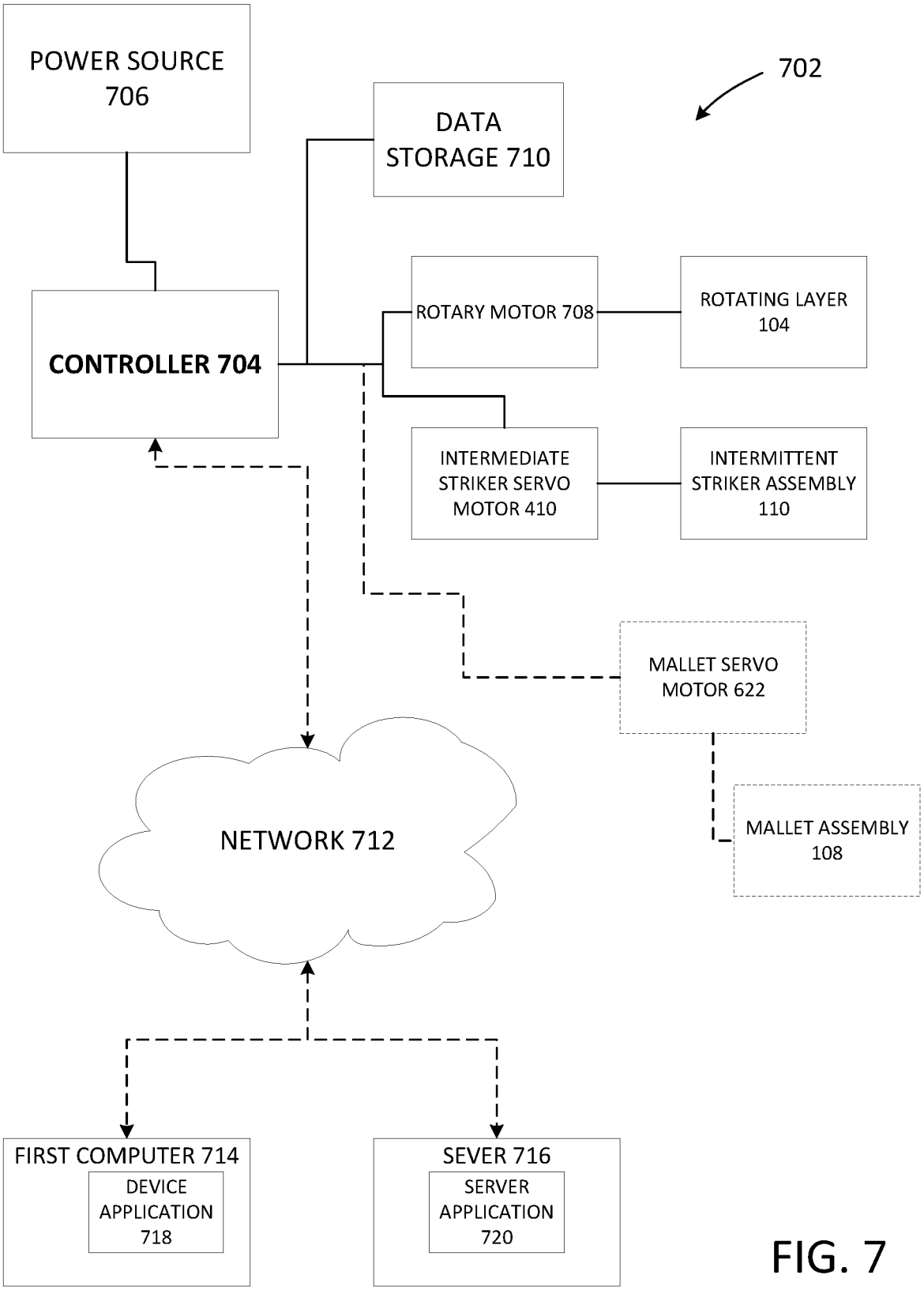
FIG. 7 a flow chart of a controller circuit 702.

FIG. 7 a flow chart of a controller circuit 702.

In one embodiment, said singing bowl player 100 can comprise a controller 704 being connected with said controls panel 130 for input/output, a power source 706, a rotary motor 708 for spinning said rotating layer 104, said mallet servo motor 622 connected to said mallet assembly 108, said intermediate striker servo motor 410 attached to said intermittent striker assembly 110, and/or a data storage 710. In one embodiment, said controller 704 can be in data communication over a network 712 with a first computer 714 running a device application 718 and/or a sever 716 running a server application 720. In one embodiment, said singing bowl player 100 can be operated according to a set of user preferences stored on said data storage 710, said device application 718, and/or said server application 720. In one embodiment, said mallet servo motor 622 may not be used to adjust around said mallet axis 620 manually prior to engaging said singing bowl player 100.

Figure 8:
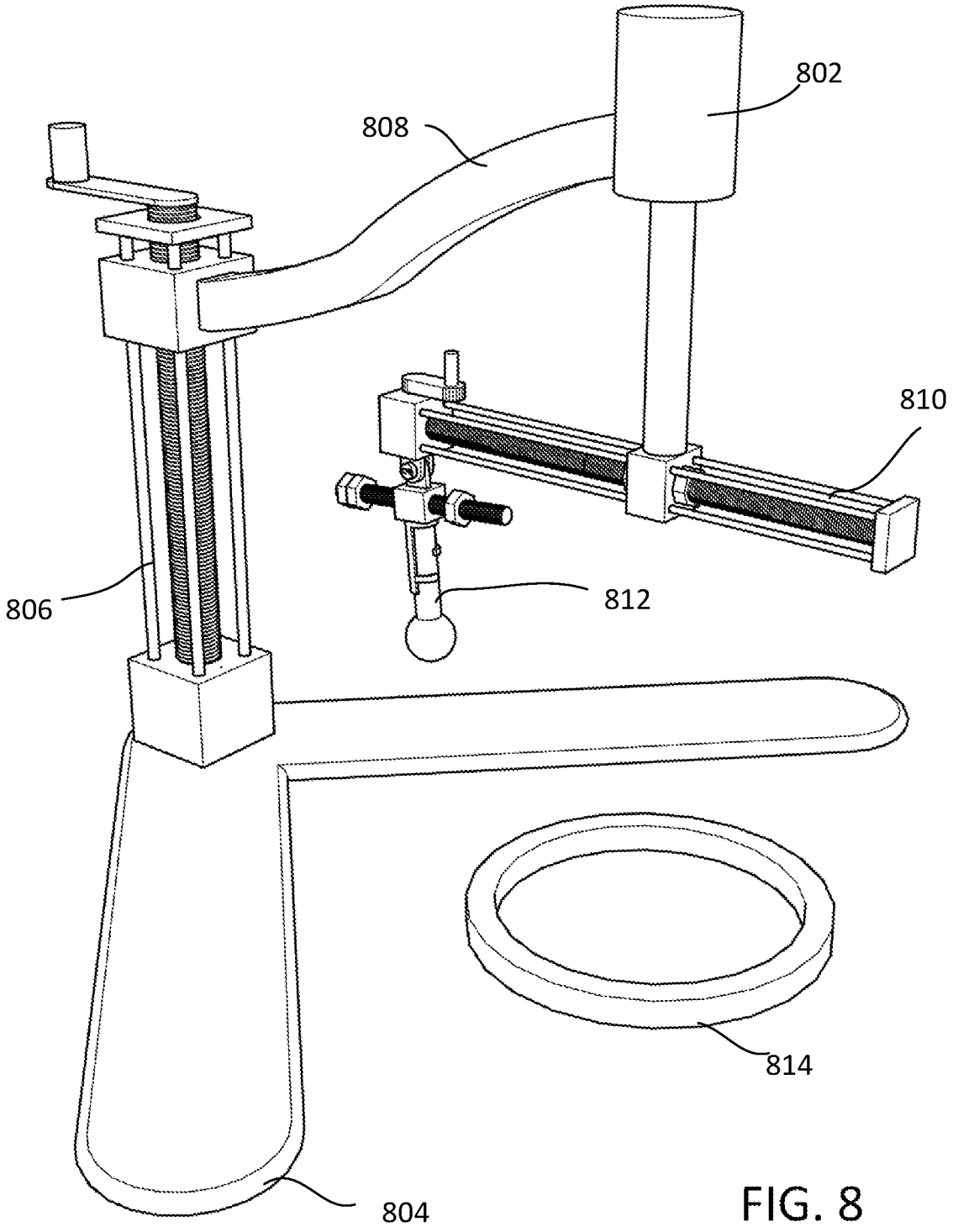
FIG. 8 illustrates a perspective overview view of a singing bowl player 802.

FIG. 8 illustrates a perspective overview view of a singing bowl player 802.

In one embodiment, said singing bowl player 802 can comprise said singing bowl player 802, a base assembly 804, a vertical assembly 806, a neck assembly 808, a horizontal assembly 810 and a striker adjustment assembly 812.

In one embodiment, said singing bowl player 802 can comprise a plurality of components designed for rotating said horizontal assembly 810 around a circular space.

Said base assembly 804 can be configured to hold and balance said horizontal assembly 810 even with said striker adjustment assembly 812 moving as disclosed herein.

In one embodiment, said vertical assembly 806 can be adapted to adjust said neck assembly 808, said horizontal assembly 810 and said striker adjustment assembly 812, as disclosed herein.

Figure 9:
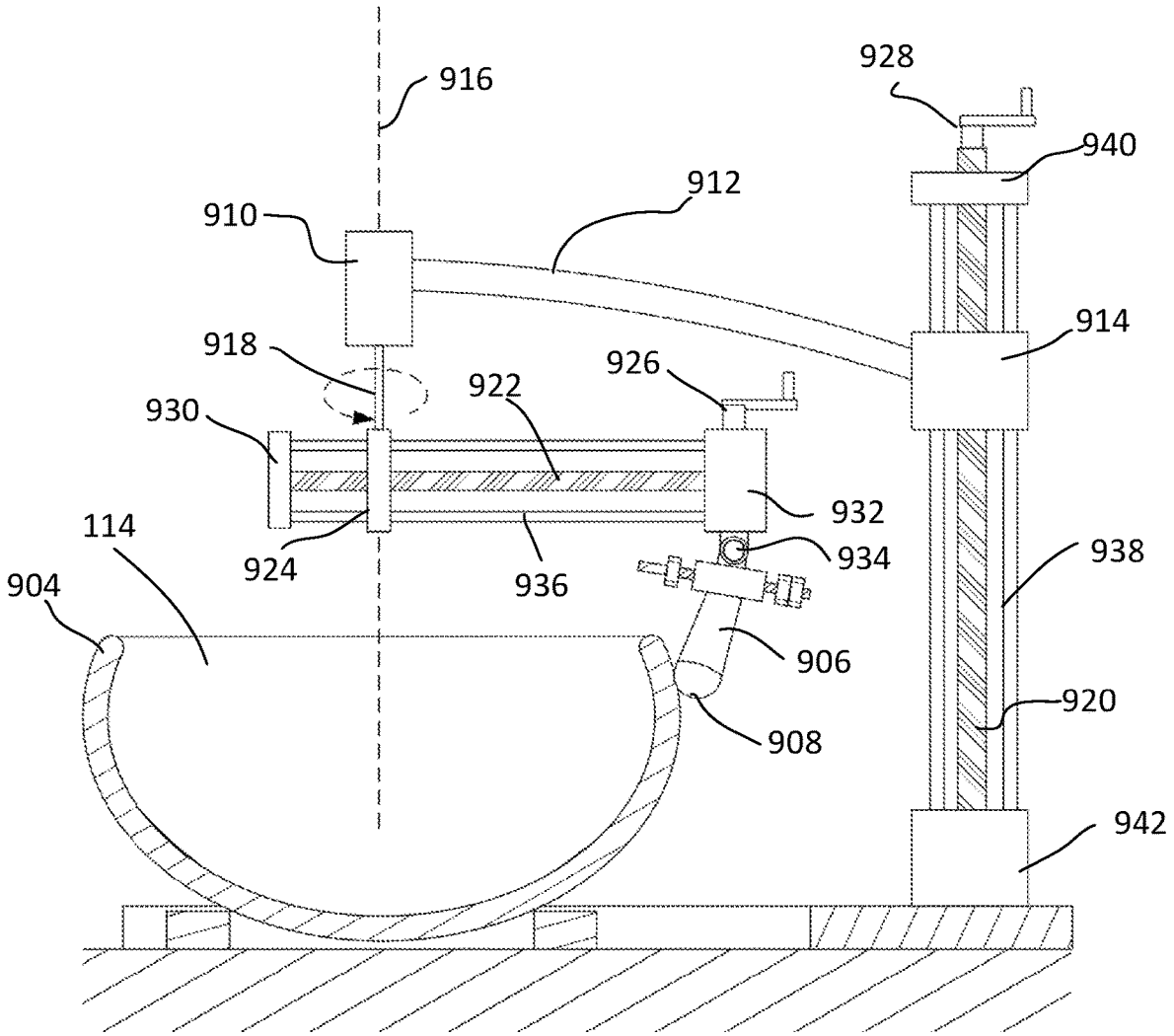
FIG. 9 illustrates an elevated first side view of said singing bowl player 802.

FIG. 9 illustrates an elevated first side view of said singing bowl player 802.

In one embodiment, said singing bowl player 100 can comprise said bowl 114.

In one embodiment, one or more guides 936 can comprise a first guide 936*a*, a second guide 936*b*, a third guide 936*c* and a fourth guide 936*d*.

In one embodiment, one or more guides 938 can comprise a second guide 938*b*, a third guide 938*c*, a fourth guide 938*d* and a top end 940.

In one embodiment, said singing bowl player 802 can comprise a bowl seat 814, a vertical-neck connector 914 and a distal end 932.

In one embodiment, said vertical assembly 806 can comprise a drive shaft 918, crank 926, said one or more guides 938, first guide 938*a*, bottom end 942 and variable height 1002.

In one embodiment, said neck assembly 808 can comprise a tip 908, a rotary motor assembly 910, an extension 912, an axis of rotation 916 and a threaded horizontal shaft 922.

In one embodiment, said horizontal assembly 810 can comprise a threaded vertical shaft 920, a neck-horizontal connector 924, a crank 928, a proximal end 930, a striker rotating axis 934 and said one or more guides 936.

Said bowl 114 can comprise a singing bowl, a standing bell, a resting bell, or an inverted bell as is known in the art. Quoting now from Wikipedia.org, said bowl 114 can comprise a bell "supported from below with the rim uppermost. Such bells are normally bowl-shaped, and exist in a wide range of sizes, from a few [centimeters] to a [meter] in diameter. They are often played by striking, but some—known as singing bowls—may also be played by rotating a mallet around the outside rim to produce a sustained musical note. "Struck bowls are used in some Buddhist religious practices to accompany periods of meditation and chanting. Struck and singing bowls are widely used for music making, meditation and relaxation, as well for personal spirituality. They have become popular with music therapists, sound healers and yoga practitioners. "Standing bells originated in China. An early form called nao took the shape of a stemmed goblet, mounted with rim uppermost, and struck on the outside with a mallet. The manufacture and use of bowls specifically for 'singing' is believed to be a modern phenomenon. Bowls that were capable of singing began to be imported to the West from around the early 1970s. Since then they have become a popular instrument in the US-originating new-age genre often marketed as 'Tibetan music'." (https://en.wikipedia.org/wiki/Standing_bell).

In one embodiment, said singing bowl player 802 can comprise a configuration of parts designed to properly strike and rotating striker 906 around a rim 904 of said bowl 114.

Said striker 906 can be called a mallet, a wand or a puja. Rotating said striker 906 around said rim 904 can excite continuous vibrations in said bowl 114 by the slip-stick mechanism. The volume and note played depend on the speed and force of said striker 906. Said singing bowl player 802 can be configured to increase/decrease a force applied to said rim 904 and to increase/decrease a rotational speed of said horizontal assembly 810.

Said neck assembly 808 can comprise said vertical-neck connector 914 being adjustably attached to said vertical assembly 806; said extension 912 being attached to said vertical-neck connector 914 at one end and said rotary motor assembly 910 at the opposite end.

Said neck assembly 808 can comprise said rotary motor assembly 910 attached to said extension 912 and said drive shaft 918; and said drive shaft 918 can attach to said neck-horizontal connector 924; and said neck-horizontal connector 924 can slidably attach to said horizontal assembly 810.

Said crank 926 can be rotated to rotate said threaded horizontal shaft 922 along its horizontal long axis. Accordingly, said crank 926 can drive rotation of threading on said threaded horizontal shaft 922; wherein, said neck-horizontal connector 924 can comprise female threading adapted to move adjustably slide said horizontal assembly 810 relative to said neck-horizontal connector 924.

Likewise, said crank 928 of said vertical assembly 806 can rotate said threaded vertical shaft 920 along its vertical axis. Accordingly, said crank 928 can rotate threading on said threaded vertical shaft 920 to selectively adjust a height of said vertical-neck connector 914.

Said horizontal assembly 810 can comprise said proximal end 930 and said distal end 932; said threaded horizontal shaft 922 and said one or more guides 936 can be arranged between said proximal end 930 and said distal end 932. Said neck-horizontal connector 924 can adjustably slide on said one or more guides 936 to maintain orientation between said proximal end 930 and said distal end 932. In one embodiment, said proximal end 930 and said distal end 932 can comprise end caps, as illustrated.

Likewise, said vertical assembly 806 can comprise said top end 940 and said bottom end 942; said threaded vertical shaft 920 and said 328/can be arranged between said top end 940 and said bottom end 942. Said vertical-neck connector 914 can adjustably slide on said one or more guides 938 to maintain orientation between said top end 940 and said bottom end 942. In one embodiment, said top end 940 and said bottom end 942 can comprise end caps, as illustrated.

In one embodiment, said striker adjustment assembly 812 can rotateably attach to said distal end 932 of said horizontal assembly 810 at said 324/.

Figure 10:
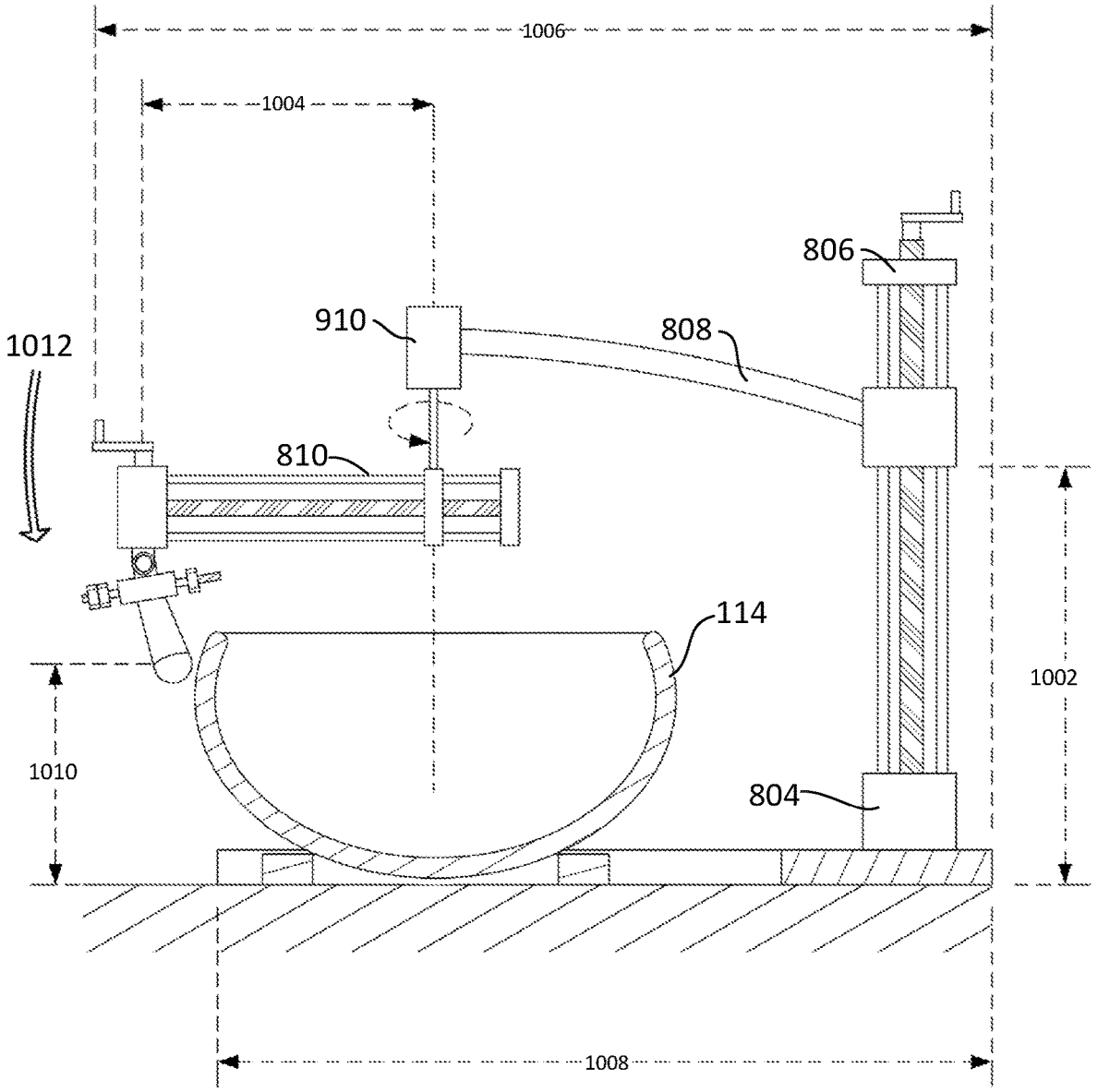
FIG. 10 illustrates an elevated front side view of said singing bowl player 802.

FIG. 10 illustrates an elevated front side view of said singing bowl player 802.

In one embodiment, said singing bowl player 802 can comprise a width 1008 and a first configuration 1102*a*. In one embodiment, said base assembly 804 can comprise a variable height 1010. In one embodiment, said vertical assembly 806 can comprise a variable radius 1004. In one embodiment, said horizontal assembly 810 can comprise an extended width 1006. In one embodiment, said tip 908 can comprise an extended downward force 1012 and a plurality of configurations 1102.

Said singing bowl player 802 can be designed to accommodate different dynamics as said rotary motor assembly 910 rotates said horizontal assembly 810 around said axis of rotation 916. As illustrated, said singing bowl player 802 is near a fully extended configuration, but-for said horizontal assembly 810 being less than fully extended. Wherein, with said horizontal assembly 810 rotated 180 degrees around from said vertical assembly 806, said horizontal assembly 810 can apply said extended downward force 1012 on said 100. As such, said singing bowl player 802 can be designed to be heavy enough to counter balance said extended downward force 1012; for example, by making said base assembly 804 heavy or by extending said width 1008 of said base assembly 804 to provide leverage over said extended downward force 1012.

Said variable radius 1004 can comprise said horizontal assembly 810 and said variable height 1002 through a plurality or configurations, as discussed herein. By adjusting said variable height 1002 and said variable radius 1004, said tip 908 can be positioned throughout at different circumferences and heights in order to accommodate different versions of said bowl 114.

Figure 11A:
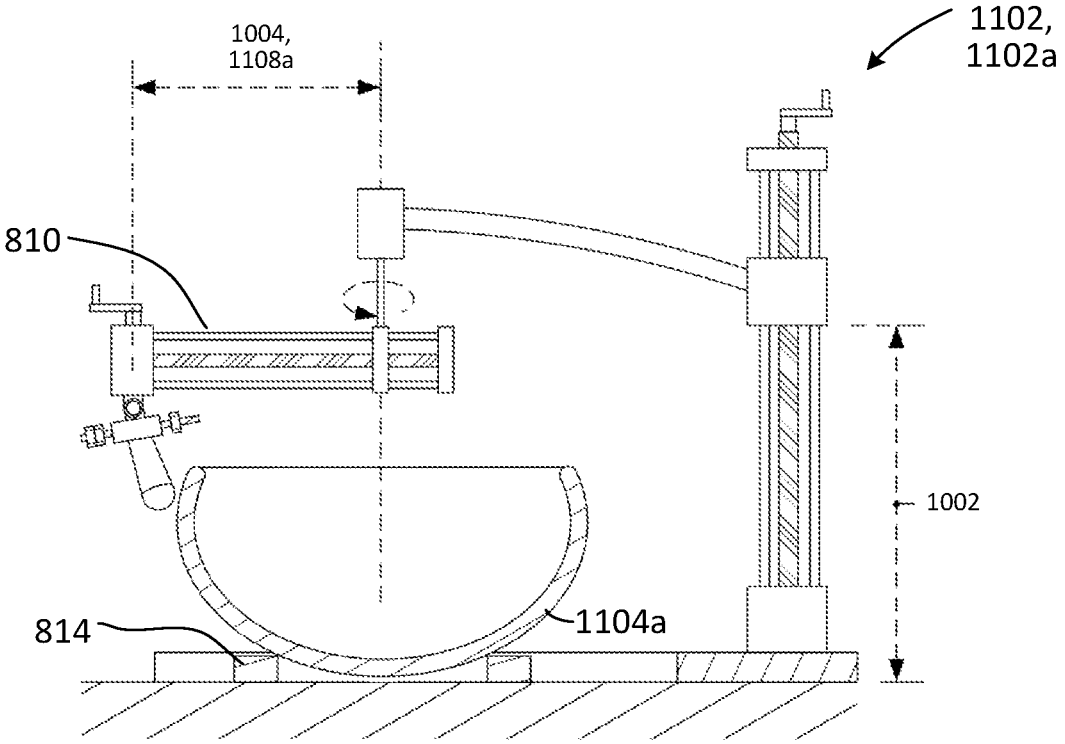
FIGS. 11A and 11B illustrate an elevated front side view of a first configuration 1102a and an elevated front side view of a second configuration 1102b.
Figure 11B:
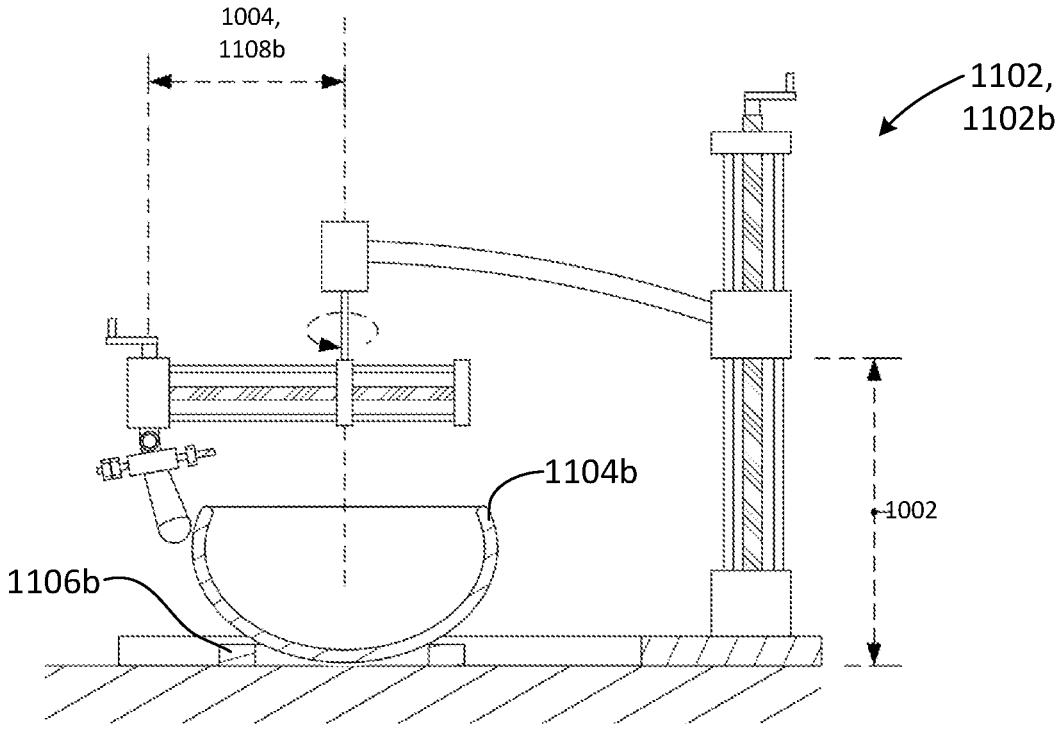

FIGS. 11A and 11B illustrate an elevated front side view of said first configuration 1102*a* and an elevated front side view of a second configuration 1102*b*.

In one embodiment, said plurality of configurations 1102 can comprise said second configuration 1102*b*, and said first configuration 1102*a*.

In one embodiment, one or more bowls 1104 can comprise a second bowl seat 1106*b* and a plurality of variable radii 1108.

In one embodiment, one or more bowl seats 1106 can comprise a striking circumference 1202 and one or more locking nuts 1302.

In one embodiment, said plurality of variable radii 1108 can comprise a rotational axis 1506 and a handle 1508.

In one embodiment, said singing bowl player 802 can comprise said second configuration 1102*b*, a first locking nut 1302*a* and a second locking nut 1302*b*.

In one embodiment, said variable radius 1004 can comprise a socket 1502 and an aperture 1504.

Said singing bowl player 802 can be adjusted into said plurality of configurations 1102 by altering said variable height 1002 and said variable radius 1004. For example, said variable height 1002 can be adjusted to 408*a*/or 408*b*/, said variable radius 1004 can be adjusted to a first variable radius 1108*a* or a second variable radius 1108*b*. Therein, said singing bowl player 802 can be adjusted to ensure appropriate fit for said bowl 114 whether a first bowl 1104*a* or a second bowl 1104*b*. Further, because said horizontal assembly 810 and said neck assembly 808 can each be adjusted through a plurality of positions, said singing bowl player 802 is highly customizable for said one or more bowls 1104.

Additionally, said singing bowl player 802 can comprise said one or more bowl seats 1106 to ensure fit and characteristics familiar to those in the art.

Figure 12:
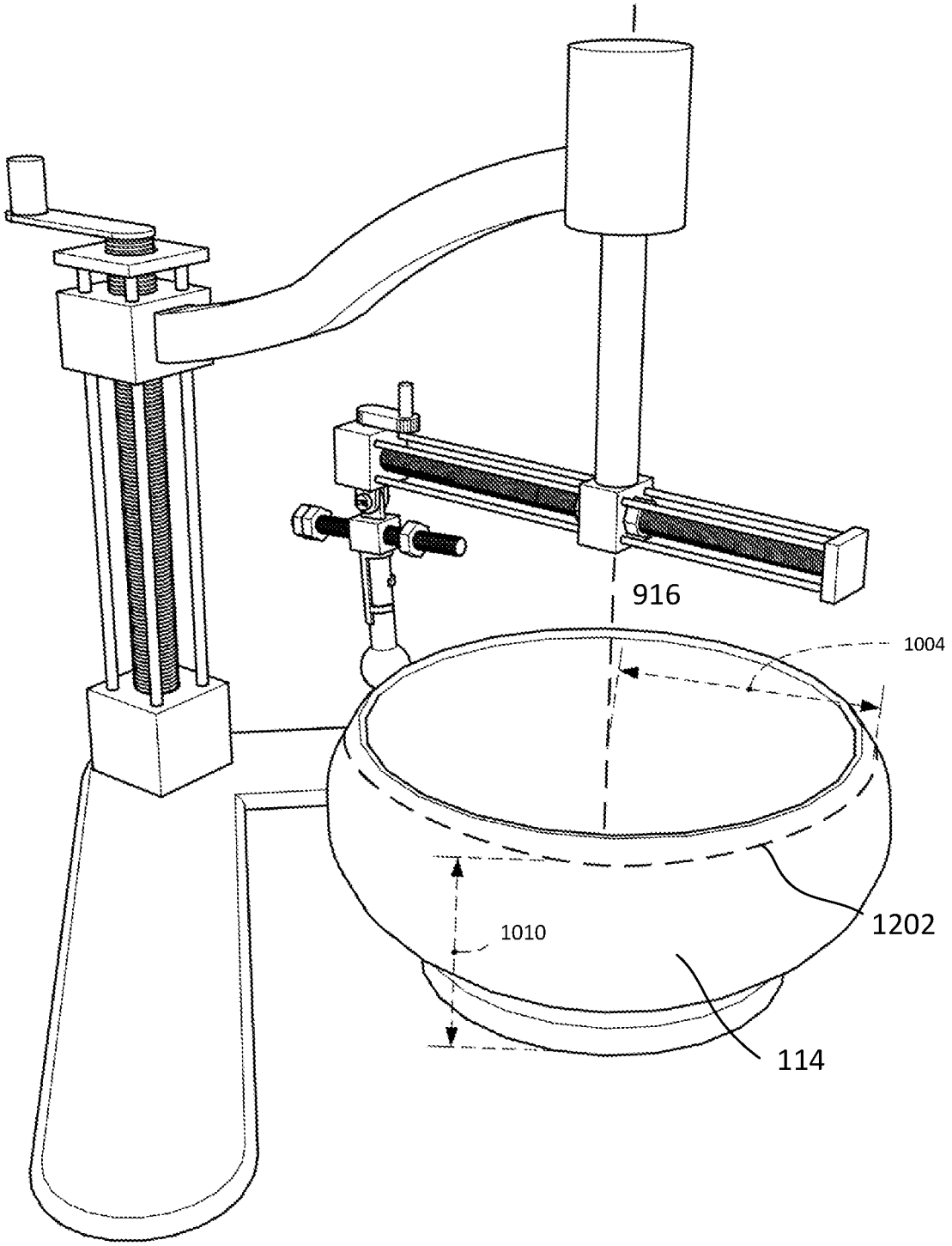
FIG. 12 illustrates a perspective overview view of said singing bowl player 802.

FIG. 12 illustrates a perspective overview view of said singing bowl player 802.

In one embodiment, said singing bowl player 802 can comprise an extension 1510. In one embodiment, said horizontal assembly 810 can comprise a fixed portions 1602.

Said singing bowl player 802 can be configured to place said striking circumference 1202 in space to consistently find and strike said rim 904 of said bowl 114.

Figure 13:
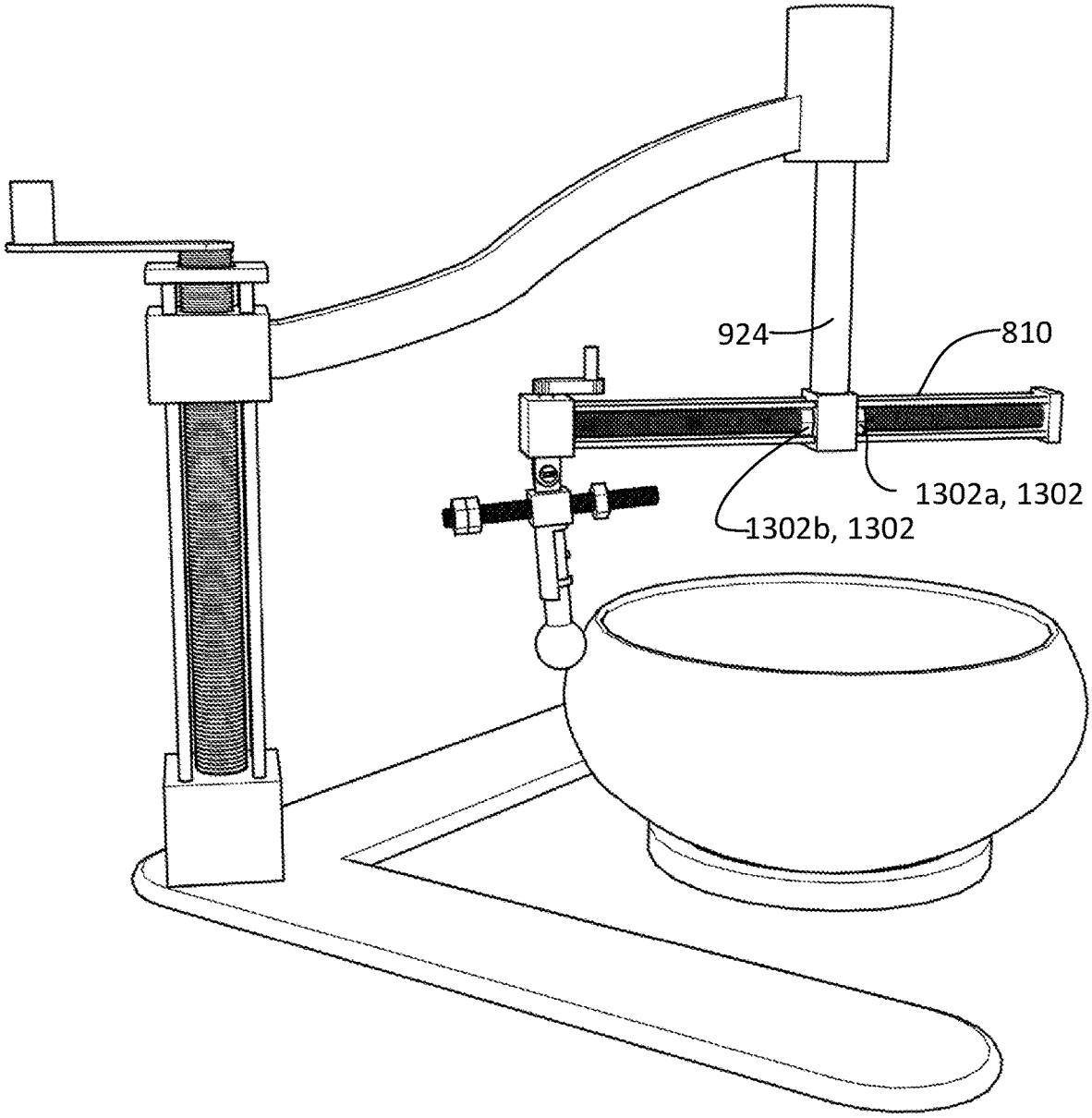
FIG. 13 illustrates a perspective side view of said singing bowl player 802.

FIG. 13 illustrates a perspective side view of said singing bowl player 802.

In one embodiment, said one or more locking nuts 1302 can comprise one or more hinges 1702 and a first hinge 1702*a*.

In one embodiment, said horizontal assembly 810 can comprise said second locking nut 1302*b*, and said first locking nut 1302*a*.

Said one or more locking nuts 1302 can selectively be positioned around said neck-horizontal connector 924 in order to lock said variable radius 1004 in a desired length.

Figure 14:
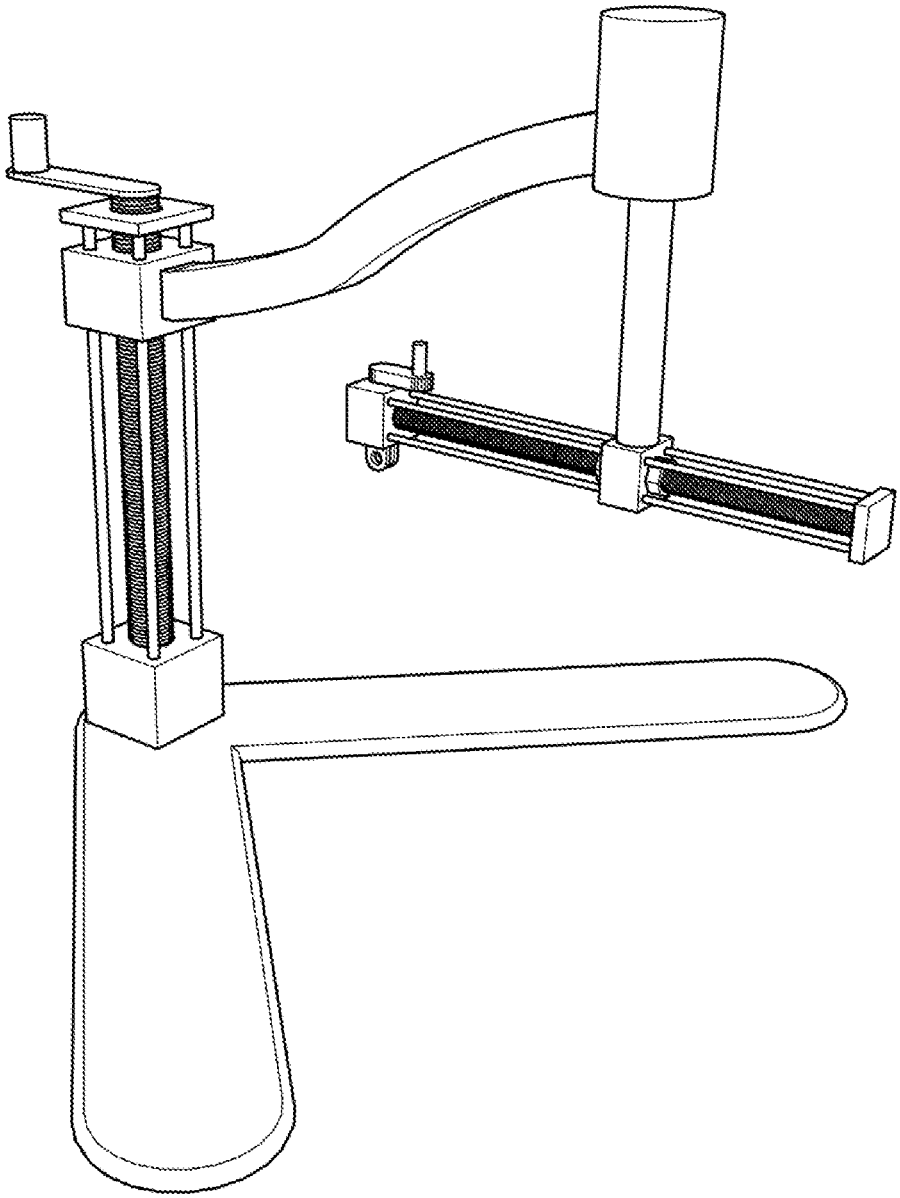
FIG. 14 illustrates a perspective overview view of said singing bowl player 802.

FIG. 14 illustrates a perspective overview view of said singing bowl player 802.

Figure 15:
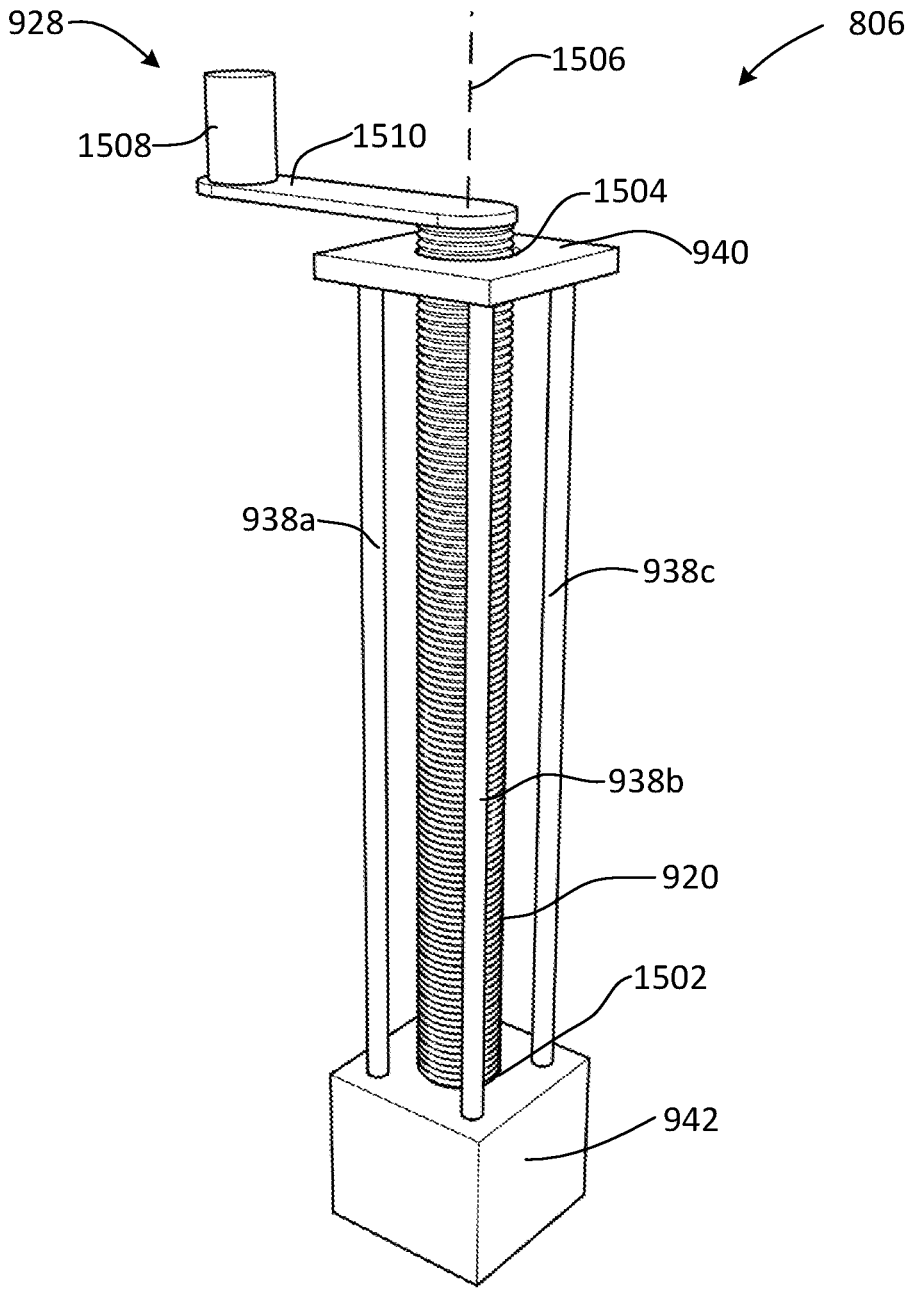
FIG. 15 illustrates a perspective overview view of a vertical assembly 806.

FIG. 15 illustrates a perspective overview view of said vertical assembly 806.

In one embodiment, said vertical assembly 806 can comprise an extension 1706.

In one embodiment, said top end 940 can comprise a handle 1704.

In one embodiment, said bottom end 942 can comprise a second hinge 1702*b*.

Figure 16:
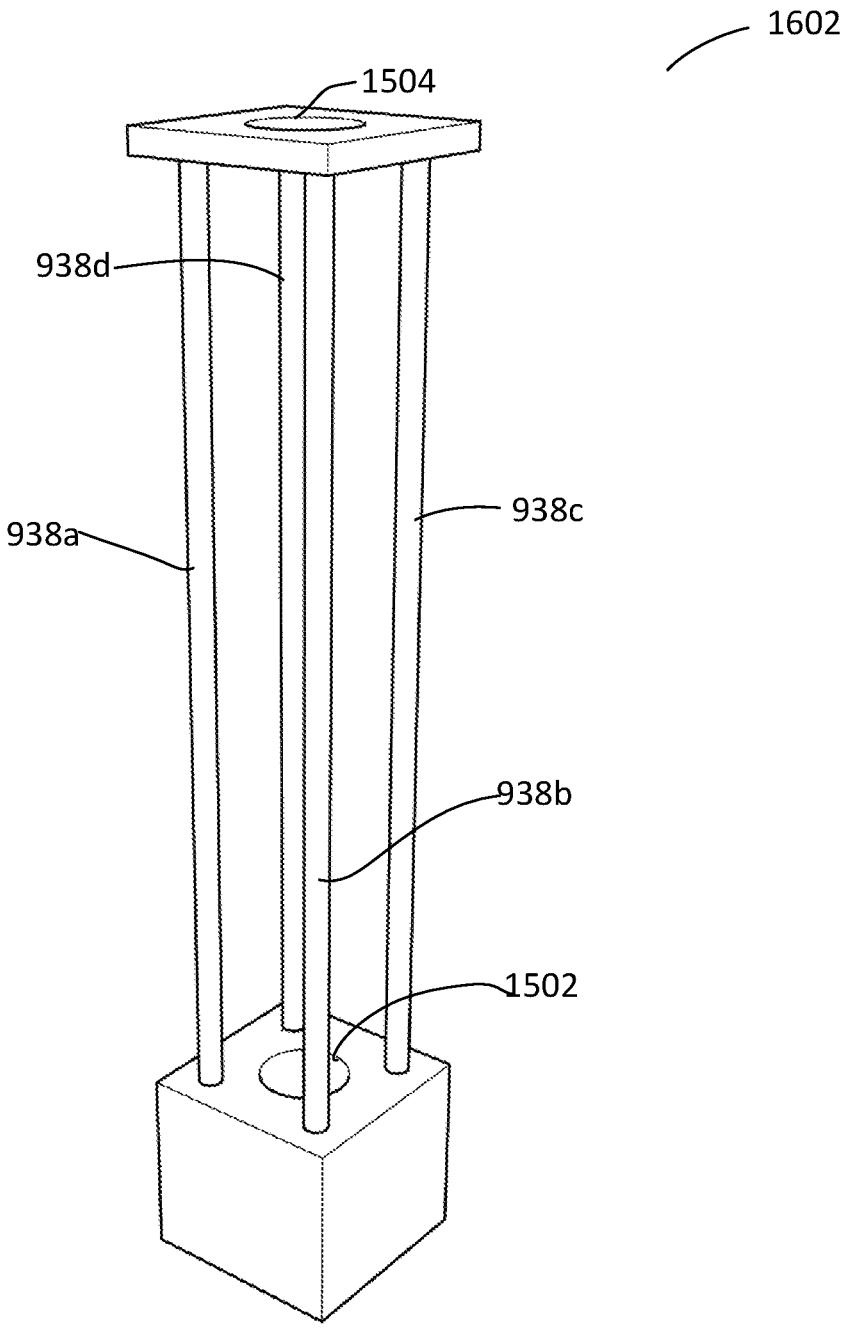
FIG. 16 illustrates a perspective overview view of a fixed portions 1602.

FIG. 16 illustrates a perspective overview view of said fixed portions 1602.

In one embodiment, said vertical assembly 806 can comprise one or more threaded shafts 1902.

Figure 17A:
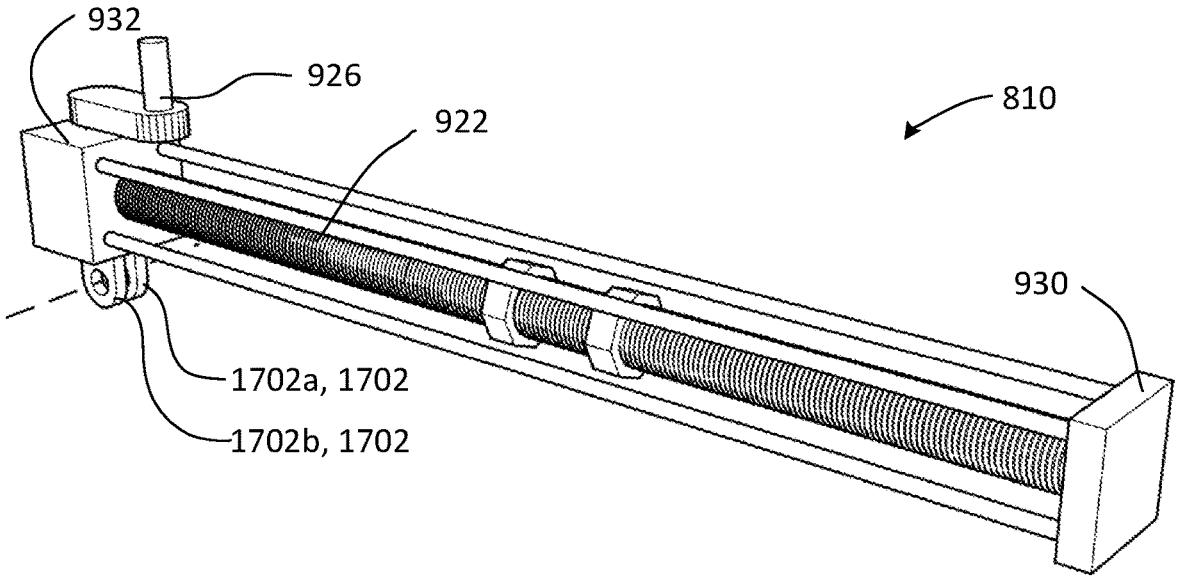
FIGS. 17A, 17B and 17C illustrate a perspective overview view, a perspective bottom side view, and an elevated side view of a horizontal assembly 810.
Figure 17B:
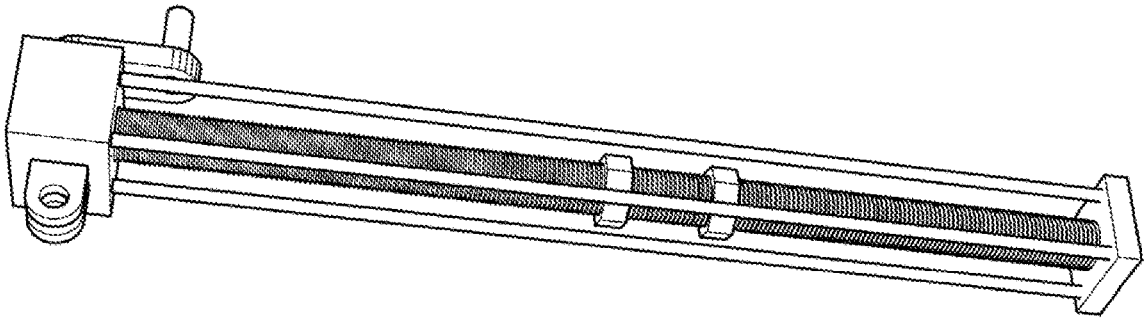
Figure 17C:
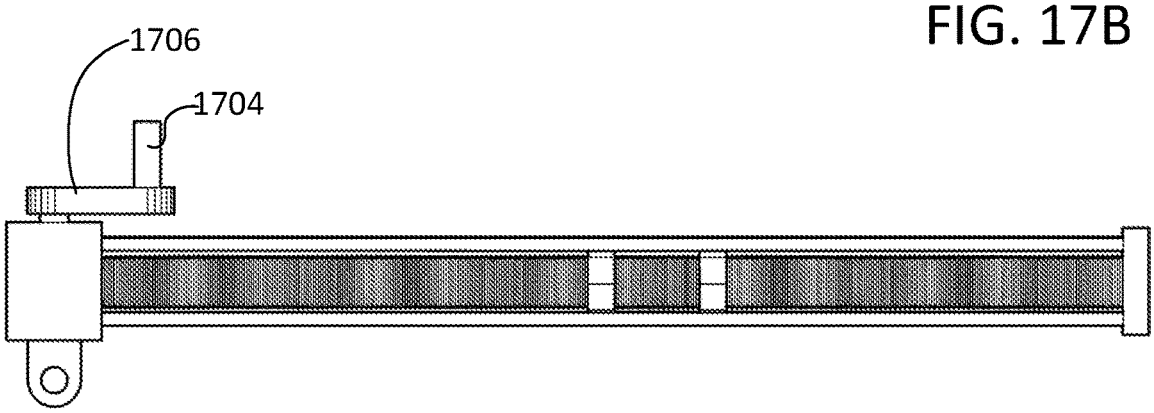

FIGS. 17A, 17B and 17C illustrate a perspective overview view, a perspective bottom side view, and an elevated side view of said horizontal assembly 810.

In one embodiment, said one or more hinges 1702 can comprise a locking pin 1910, said second hinge 1702*b*, and said first hinge 1702*a*.

In one embodiment, said horizontal assembly 810 can comprise a hinge 1908.

Figure 18A:
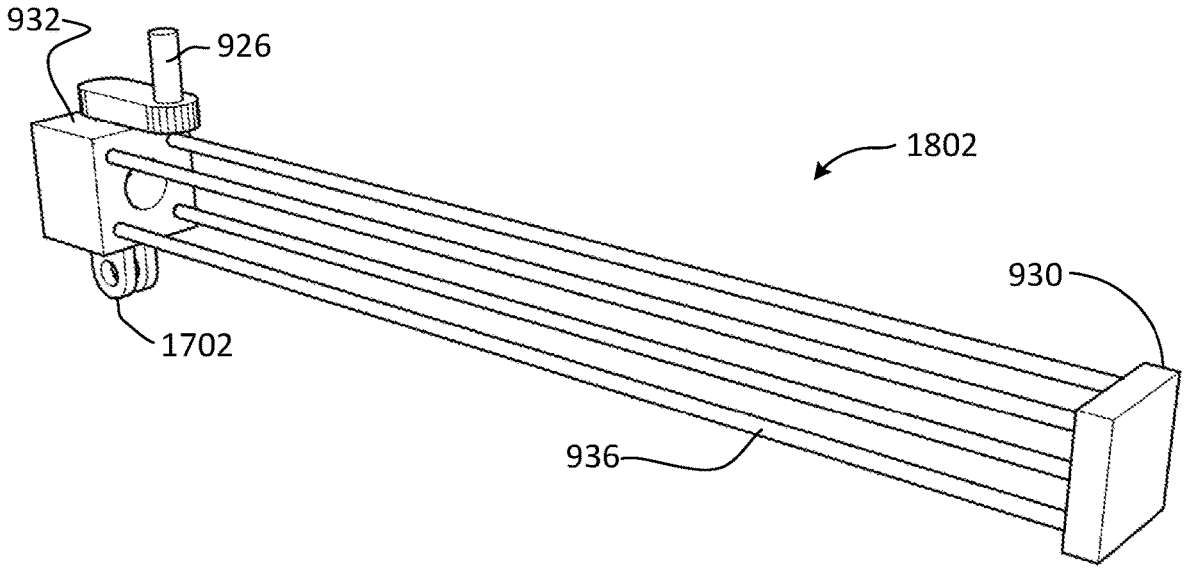
FIGS. 18A and 18B illustrate a perspective overview view and bottom side view of fixed portions 1802.
Figure 18B:
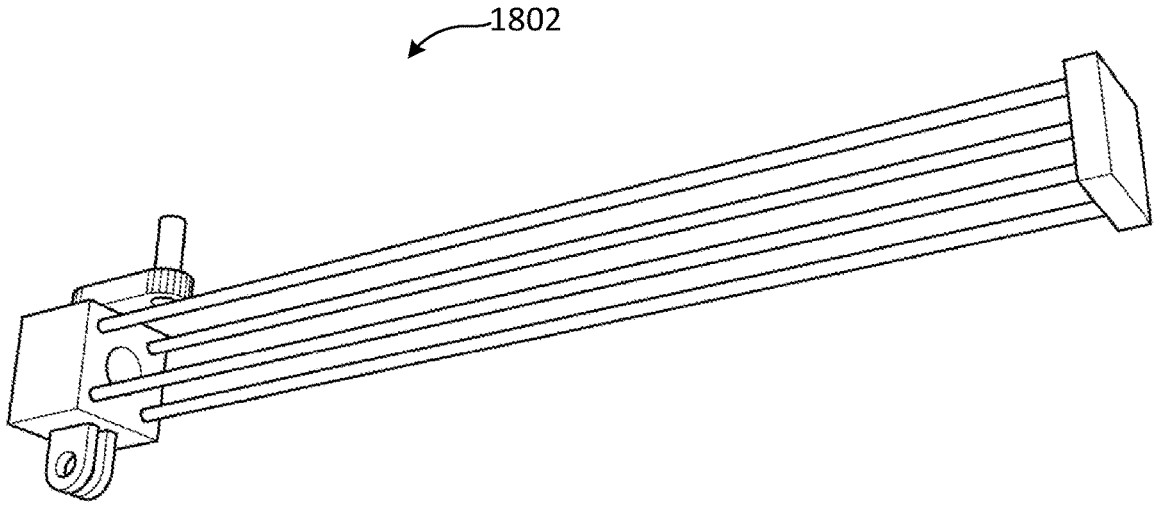

FIGS. 18A and 18B illustrate a perspective overview view and bottom side view of fixed portions 1802.

In one embodiment, said horizontal assembly 810 can comprise a variable striking force 2006.

Figure 19:
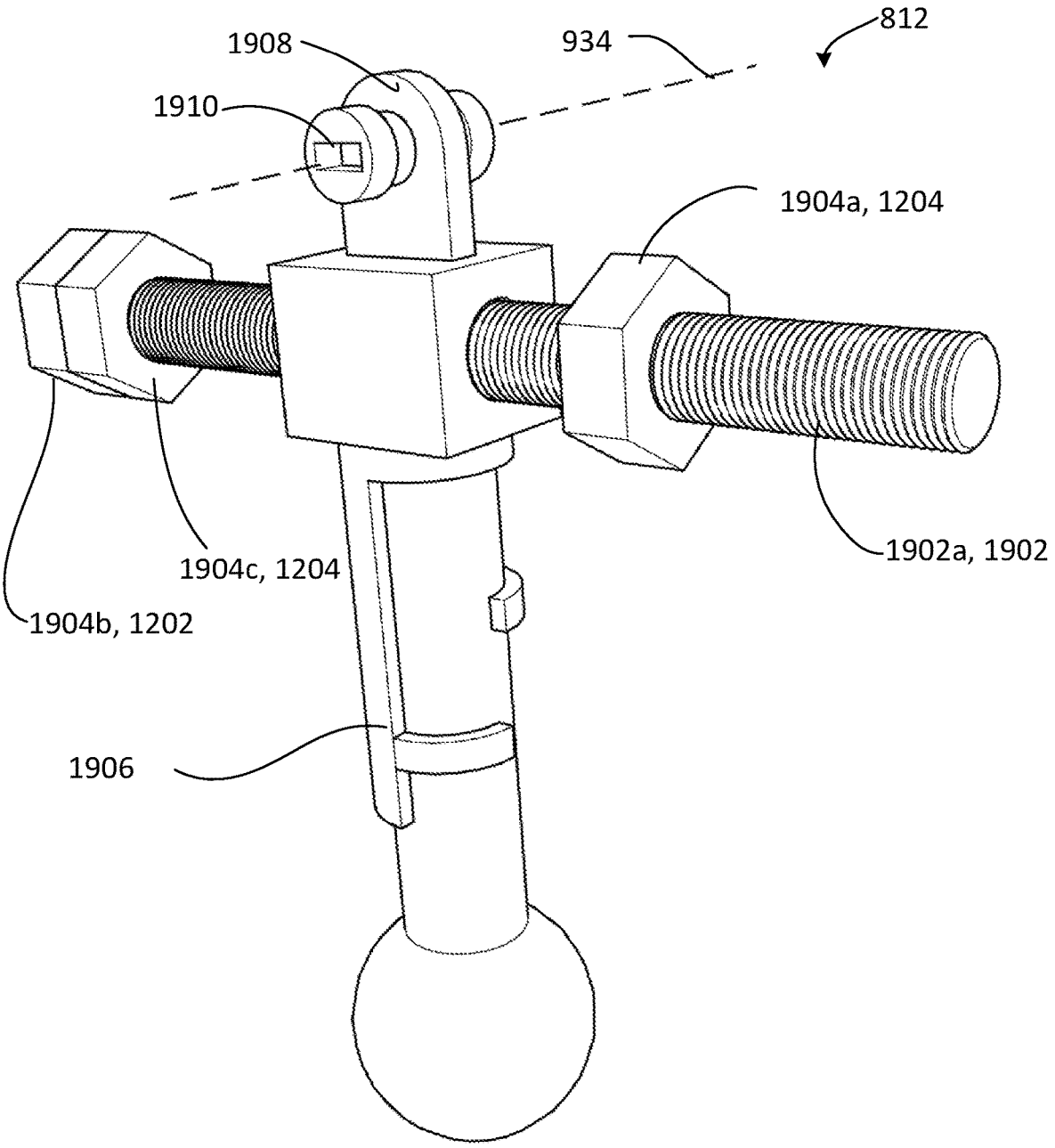
FIG. 19 illustrates a perspective overview view of a striker adjustment assembly 812.

FIG. 19 illustrates a perspective overview view of said striker adjustment assembly 812.

In one embodiment, said striker adjustment assembly 812 can comprise said locking pin 1910, said hinge 1908, holder 1906, one or more weighted nuts 1904, and said one or more threaded shafts 1902.

In one embodiment, said one or more threaded shafts 1902 can comprise said one or more weighted nuts 1904, and a first threaded shaft 1902*a*.

In one embodiment, said one or more weighted nuts 1904 can comprise third weighted nut 1904*c*, first weighted nut 1904*a*, and a second weighted nut 1904*b*.

In one embodiment, said striker adjustment assembly 812 can be configured to selectively hold said striker 906 with said holder 1906.

Said one or more threaded shafts 1902 can extend in substantially horizontal directions from said striker 906 and said holder 1906. Wherein, said singing bowl player 802 can have a pitch of said striker adjustment assembly 812 be adjusted by arranging said one or more weighted nuts 1904 along said one or more threaded shafts 1902.

Said hinge 1908 can be selectively attached to said one or more hinges 1702 with said locking pin 1910 and thereby creating said striker rotating axis 934 for movement of said striker adjustment assembly 812.

Figure 20:
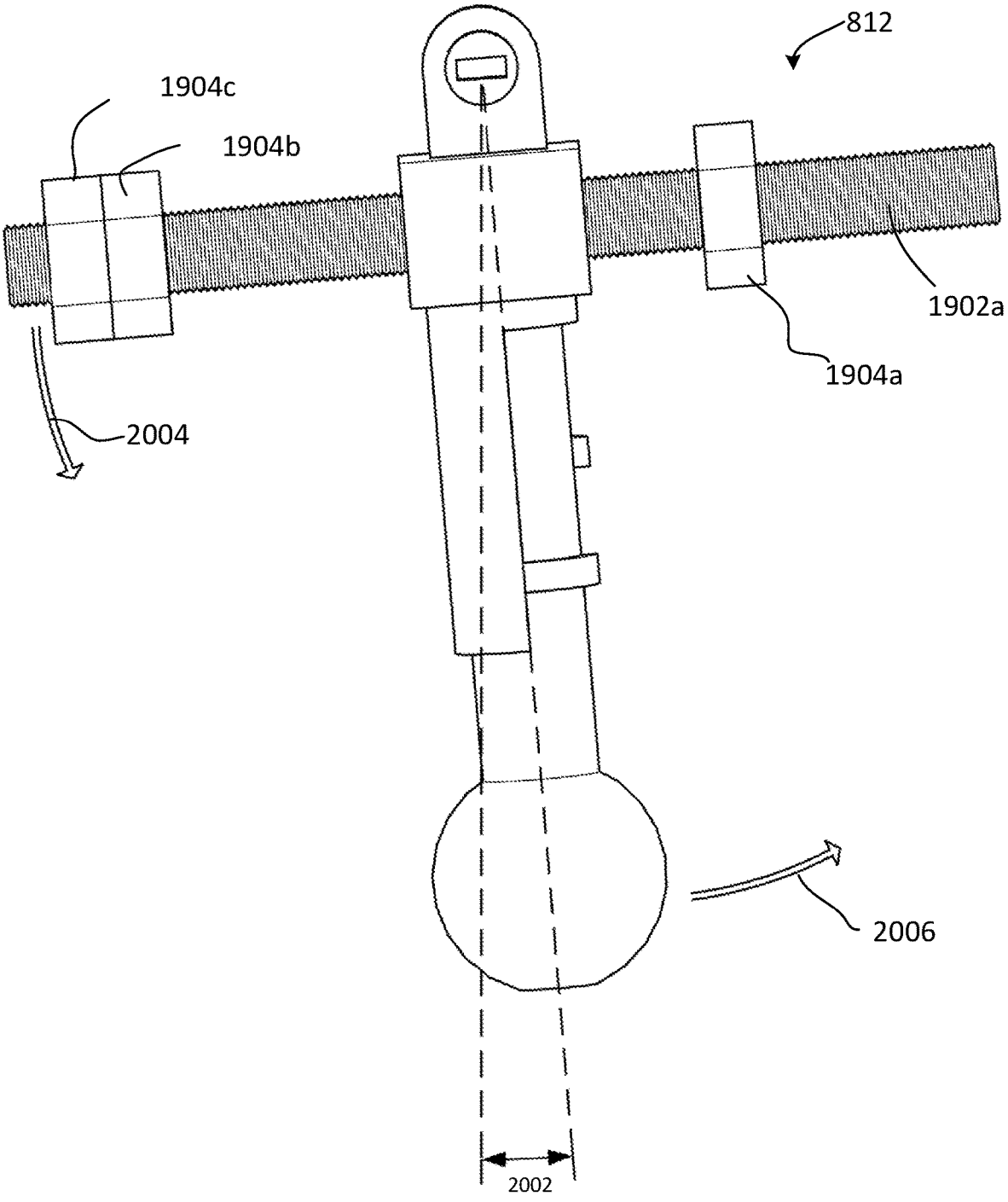
FIG. 20 illustrates an elevated front side view of said striker adjustment assembly 812.

FIG. 20 illustrates an elevated front side view of said striker adjustment assembly 812.

In one embodiment, said crank 926 can comprise a variable tilt 2002 and a variable downward force 2004.

In one embodiment, said striker adjustment assembly 812 can comprise said variable striking force 2006, said variable downward force 2004, and said variable tilt 2002.

In one embodiment, said variable striking force 2006 can be adjusted by repositioning said one or more weighted nuts 1904 along said one or more threaded shafts 1902. For example, said first weighted nut 1904*a* could be moved next to said third weighted nut 1904*c*, which would increase said variable downward force 2004 and thereby increase said variable striking force 2006.

Calculations of said variable downward force 2004 and said variable striking force 2006 can be made by considering the mass of the parts of said striker adjustment assembly 812, the lengths of said one or more threaded shafts 1902 and the position of said tip 908, as is known in the art. However, as a practical matter, users will enjoy the benefit of organically adjusting said variable striking force 2006 by rotating said one or more weighted nuts 1904 along said one or more threaded shafts 1902.

Likewise, a very light forces can be created by nearly balancing said one or more weighted nuts 1904 with one another. Note further, that even numbers of said one or more weighted nuts 1904 can be used, and even none in some cases. Negative forces can be achieved by balancing said striker adjustment assembly 812 to press said first threaded shaft 1902*a* down rather than up.

Figure 21:
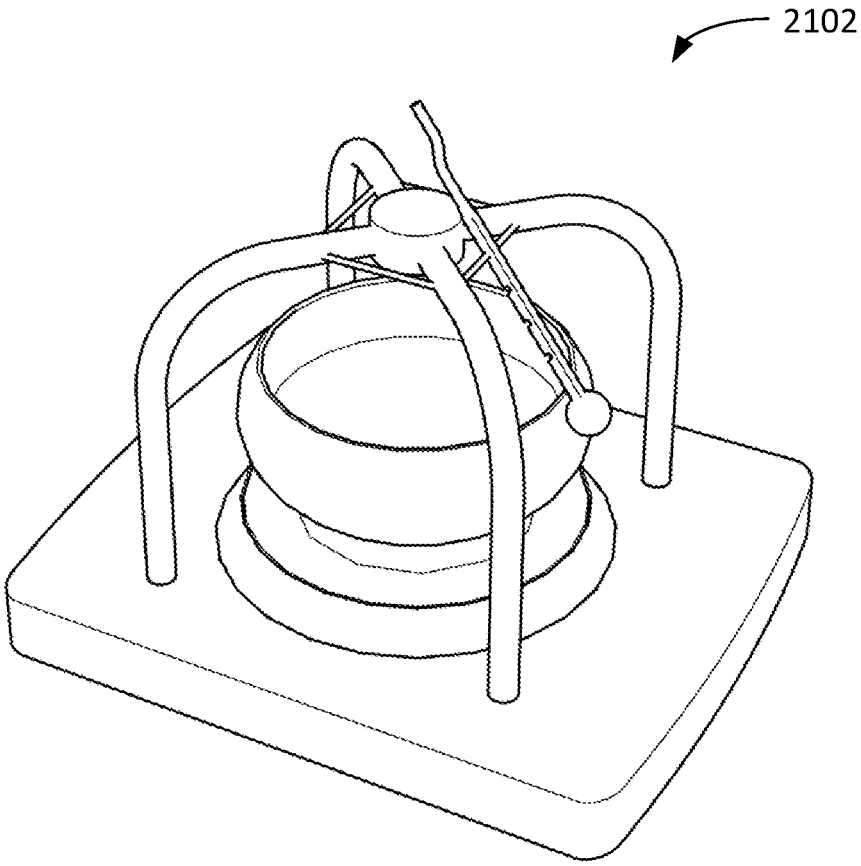
FIG. 21 illustrates a perspective overview view of a second alternative bowl player 2102.

FIG. 21 illustrates a perspective overview view of a second alternative bowl player 2102.

Figure 22:
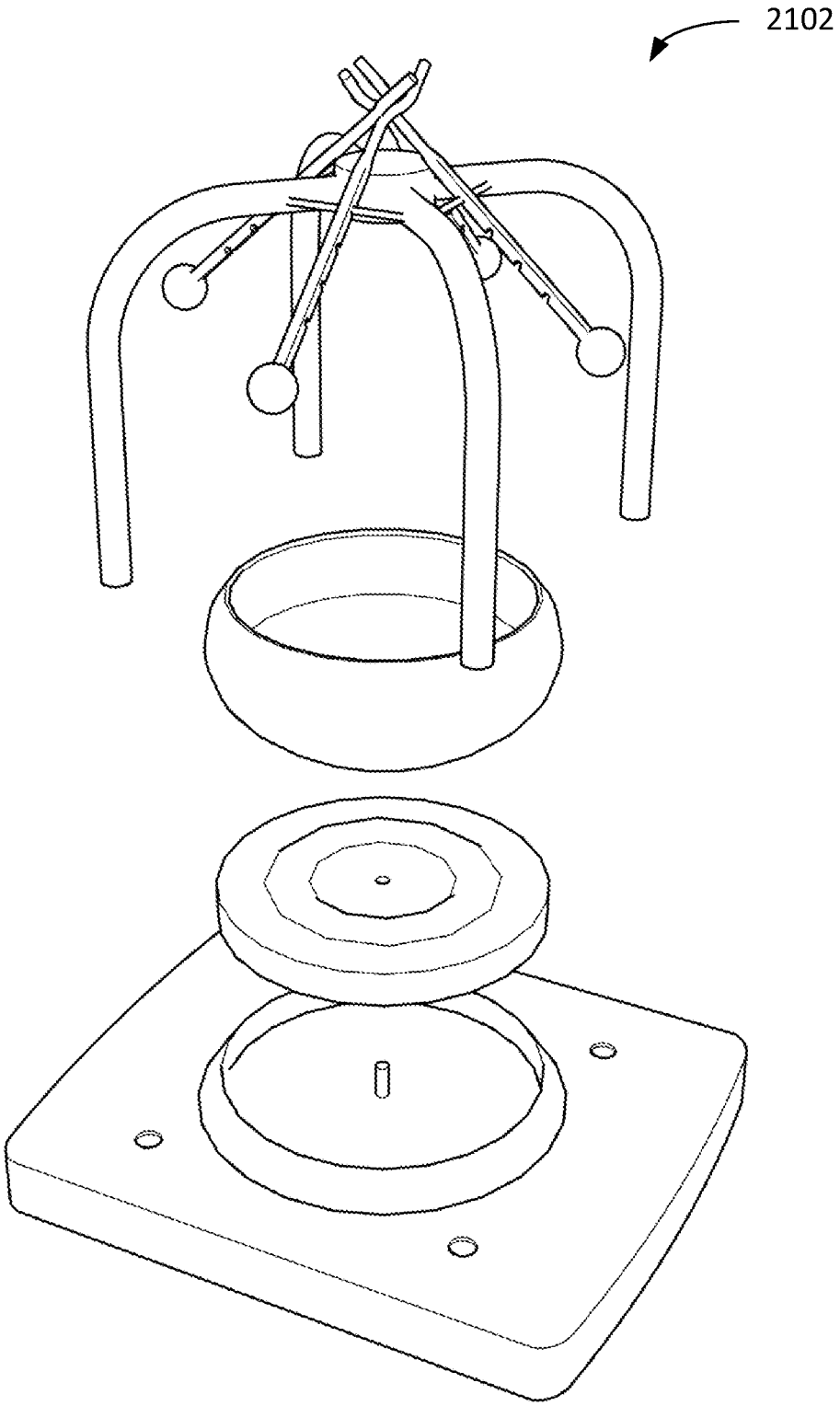
FIG. 22 illustrates a perspective overview view of said second alternative bowl player 2102.

FIG. 22 illustrates a perspective overview view of said second alternative bowl player 2102.

Figure 23:
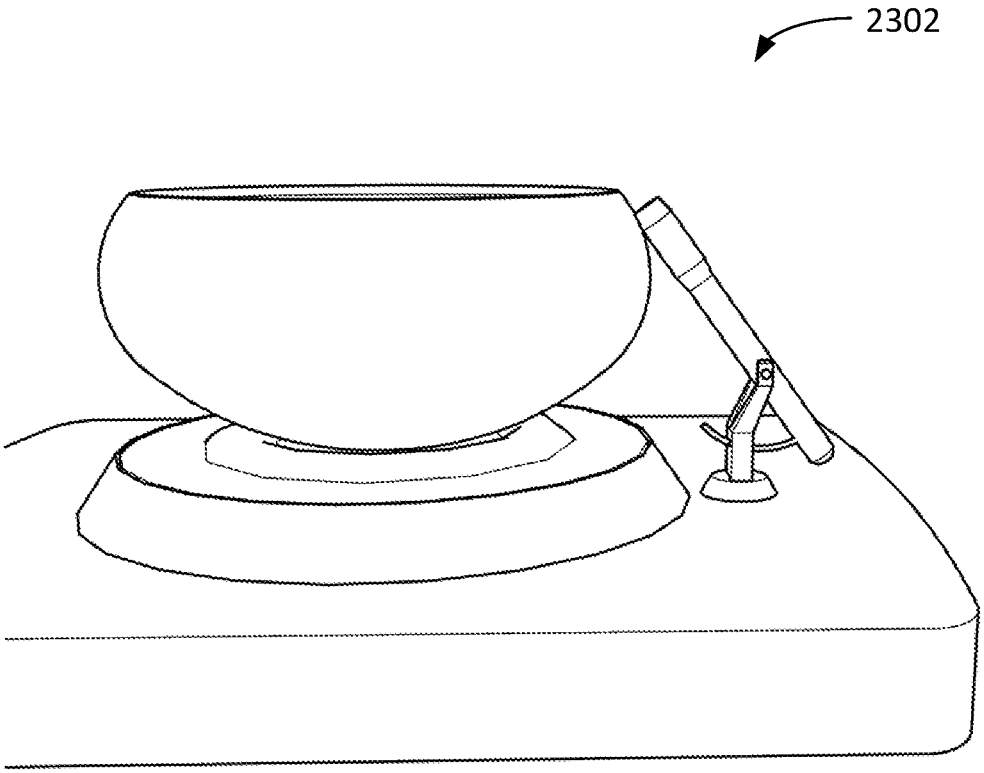
FIG. 23 illustrates a perspective overview view of a third alternative bowl player 2302.

FIG. 23 illustrates a perspective overview view of a third alternative bowl player 2302.

Figure 24:
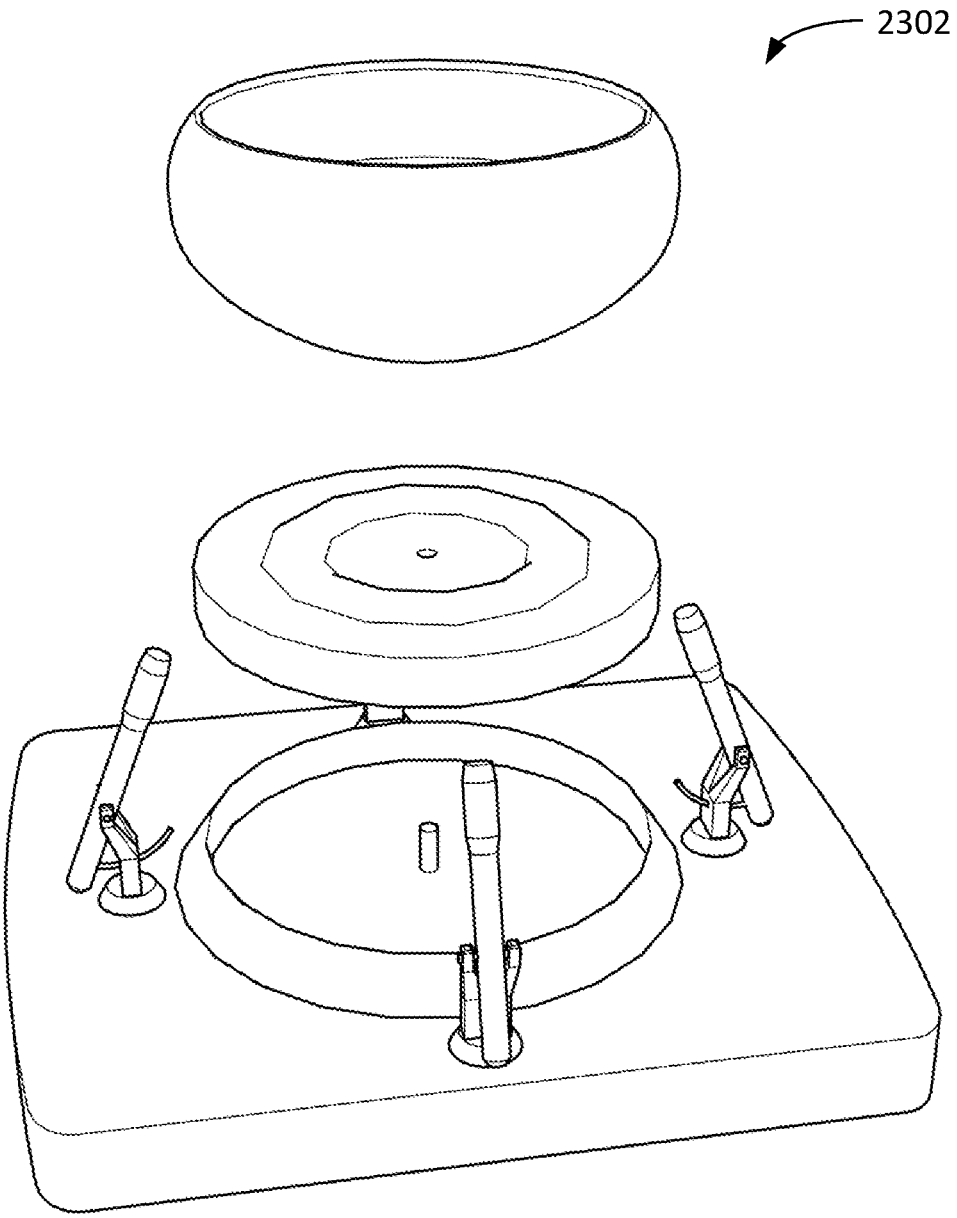
FIG. 24 illustrates a perspective first side view of said third alternative bowl player 2302.

FIG. 24 illustrates a perspective first side view of said third alternative bowl player 2302.

Figure 25A:
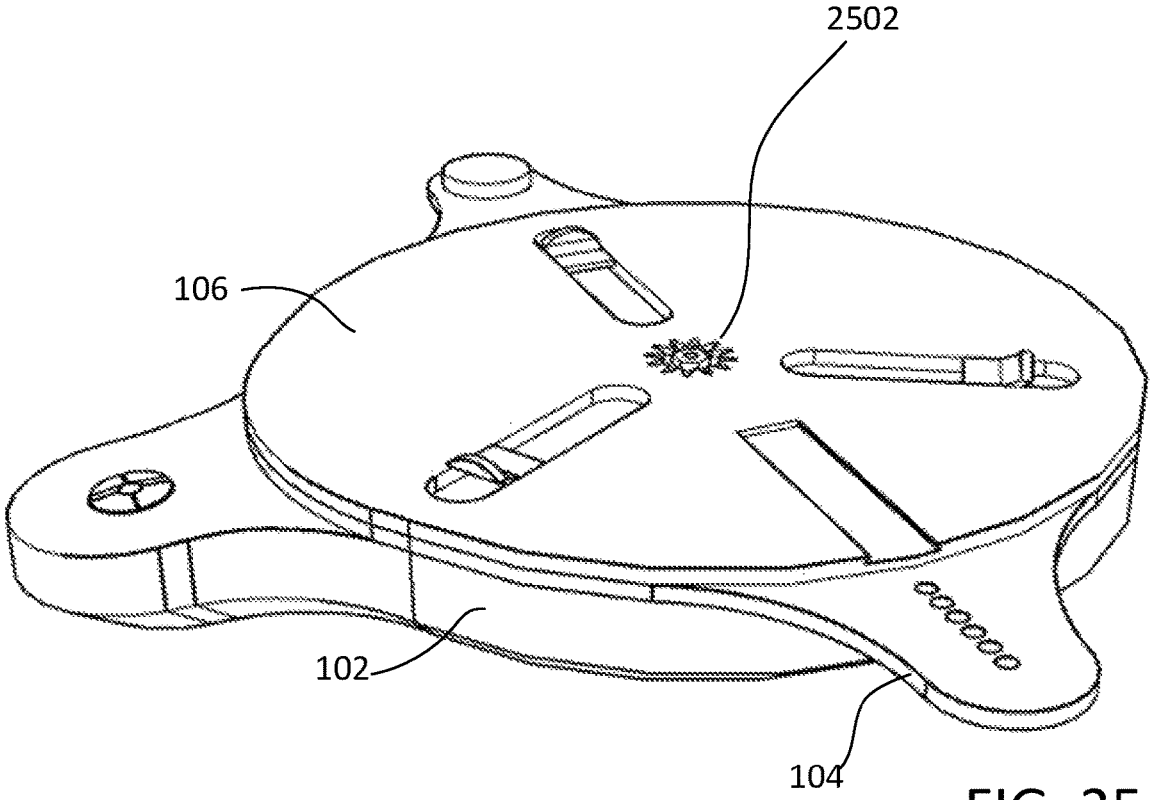
FIGS. 25A and 25B illustrate a perspective overview and detailed view of said top plate 106, said rotating layer 104, and said base 102 with drive assembly 2502.
Figure 25B:
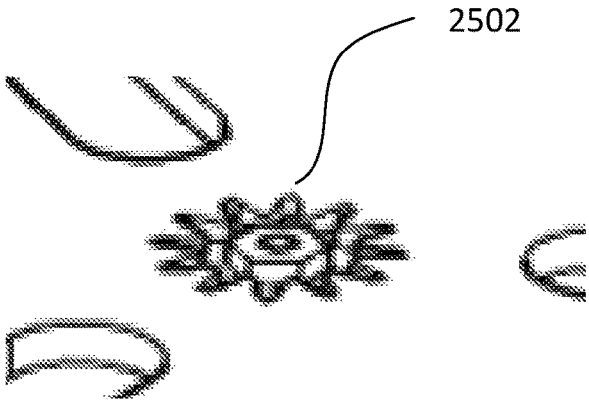

FIGS. 25A and 25B illustrate a perspective overview and detailed view of said top plate 106, said rotating layer 104, and said base 102 with said drive assembly 2502.

In one embodiment, said drive assembly 2502 and the following discussion can comprise a replacement for dashed line illustrations found in said top plate central aperture 204, said drive system placeholder 308 and said lower drive system placeholder 512.

As show in FIG. 25B, said drive assembly 2502 can be completely below or flush with said top plate 106 so as not to impede said bowl 114.

Figure 26:
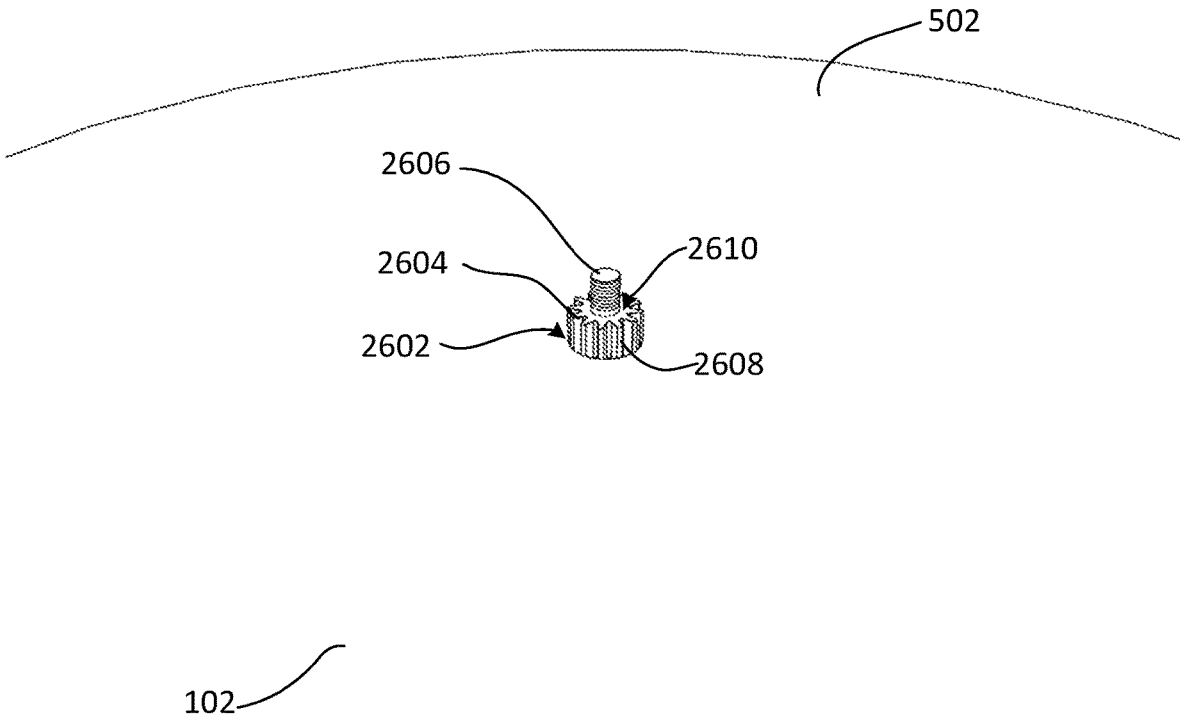
FIG. 26 illustrates a perspective overview of a top surface 502 of said base 102.

FIG. 26 illustrates a perspective overview of said top surface 502 of said base 102.

In one embodiment, said base 102 can comprise a drive aperture 2602 in said top surface 502, a drive gear 2604, and a fixed threaded fastener 2606. In one embodiment, said fixed threaded fastener 2606, and said drive gear 2604 can comprise portions of said drive assembly 2502.

In one embodiment, said fixed threaded fastener 2606, said drive gear 2604, and said drive aperture 2602 can be substantially centered in said top surface 502. In one embodiment, said fixed threaded fastener 2606 can comprise a plurality of teeth 2608 about its exterior, and an inner aperture 2610. In one embodiment, said inner aperture 2610 can comprise a smooth inner wall to rotate freely around said fixed threaded fastener 2606. Said plurality of teeth 2608 can be configured to engage another set of gears, as is known in the art.

In one embodiment, said rotary motor assembly 910 can be within said base 102 and connected to said drive gear 2604 to provide drive power according to user preferences.

Figure 27:
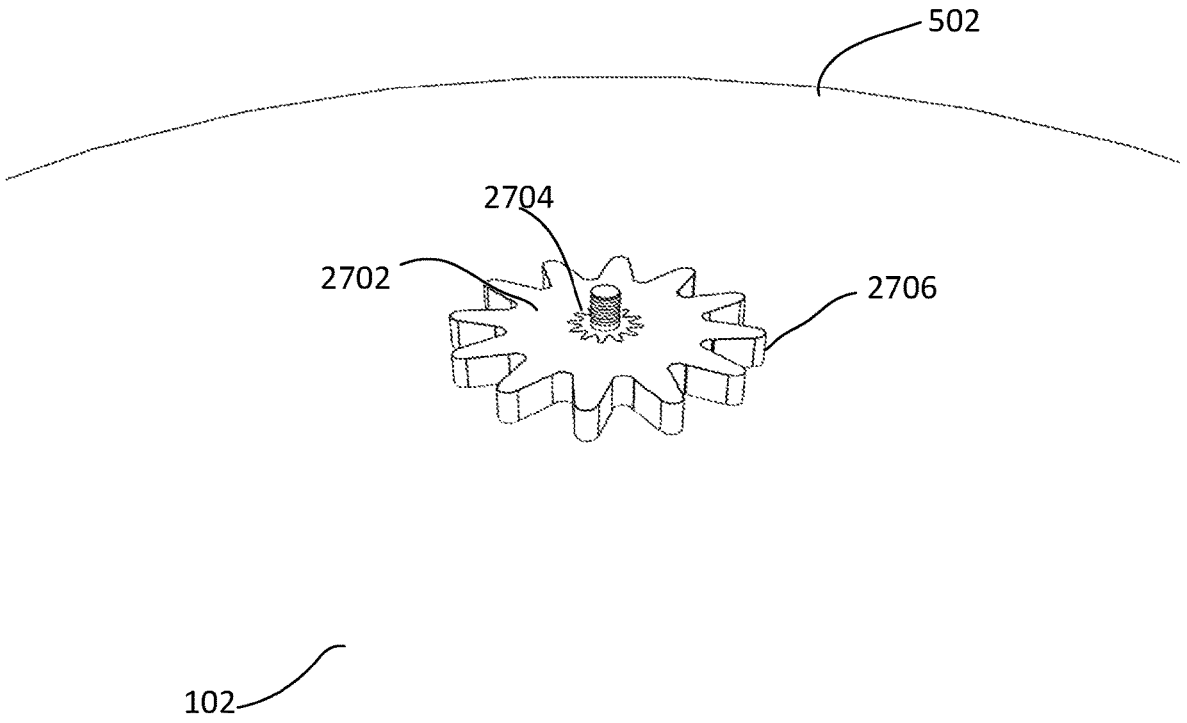
FIG. 27 illustrates a perspective overview of said top surface 502 of said base 102 with the addition of a second rotating layer gear 2702.

FIG. 27 illustrates a perspective overview of said top surface 502 of said base 102 with the addition of a second rotating layer gear 2702.

In one embodiment, said second rotating layer gear 2702 can comprise a female gear aperture 2704 at its center and a plurality of teeth 2706 about its perimeter.

Figure 28:
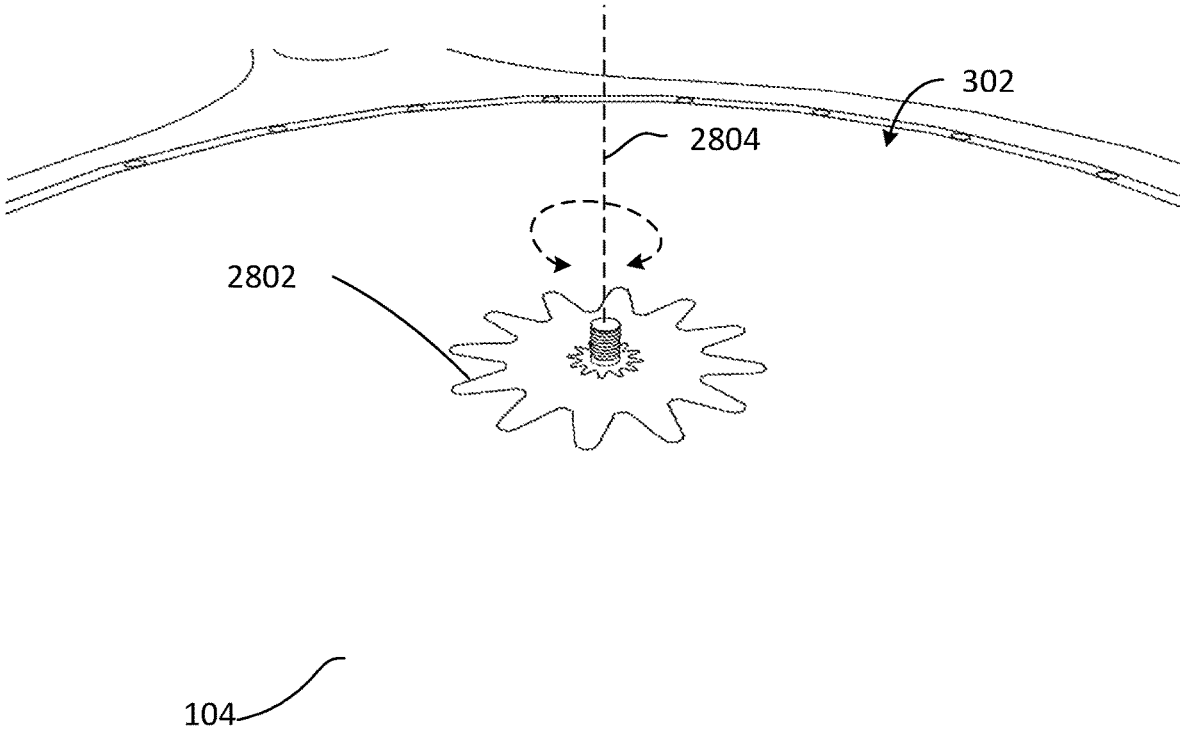
FIG. 28 illustrates a perspective overview of a top surface 302 of said rotating layer 104.

FIG. 28 illustrates a perspective overview of said top surface 302 of said rotating layer 104.

In one embodiment, said rotating layer 104 can comprise a female gear aperture 2802 configured to lock around said second rotating layer gear 2702 and receive a drive force 2804 therefrom.

Figure 29:
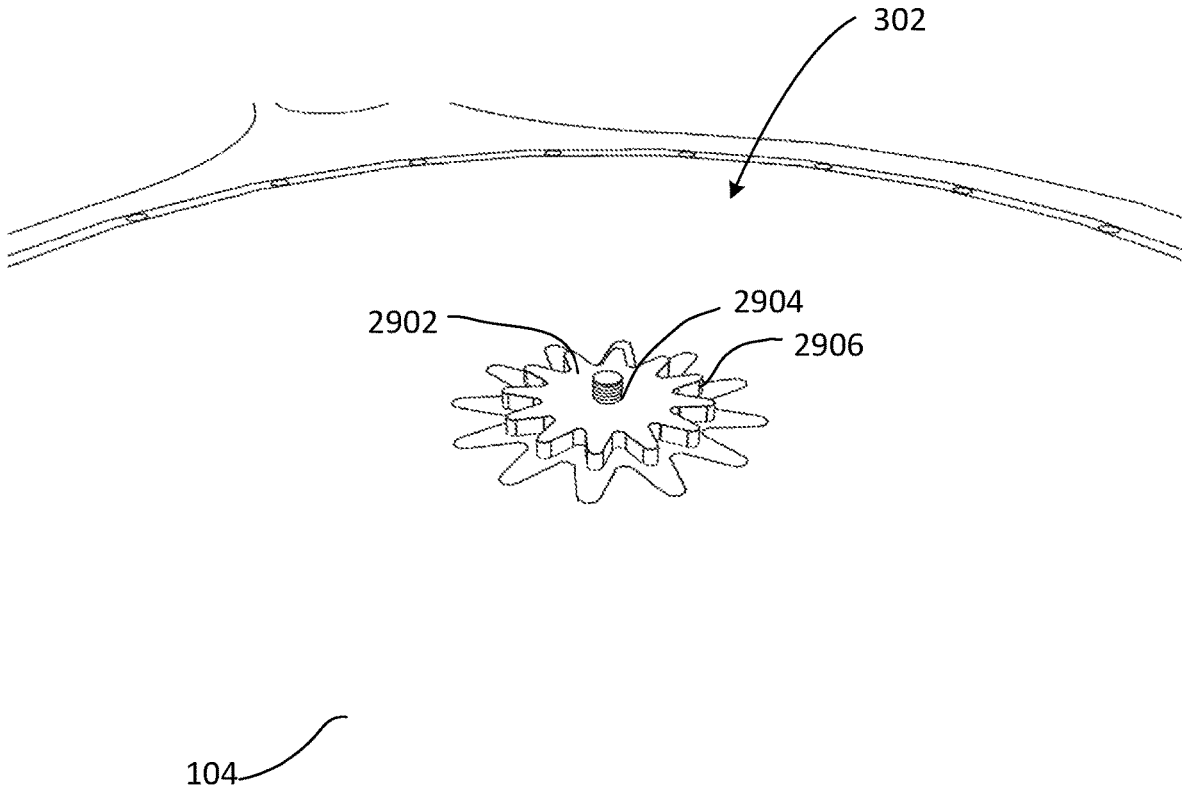
FIG. 29 illustrates a perspective overview of said top surface 302 of said rotating layer 104 with the addition of a top layer gear 2902.

FIG. 29 illustrates a perspective overview of said top surface 302 of said rotating layer 104 with the addition of a top layer gear 2902.

In one embodiment, said top layer gear 2902 can stack on top of said second rotating layer gear 2702, and said drive gear 2604. Said top layer gear 2902 can comprise a threaded central aperture 2904 and a plurality of teeth 2906 about its exterior perimeter. In one embodiment, said threaded central aperture 2904 can screw into a portion of said fixed threaded fastener 2606.

Figure 30:
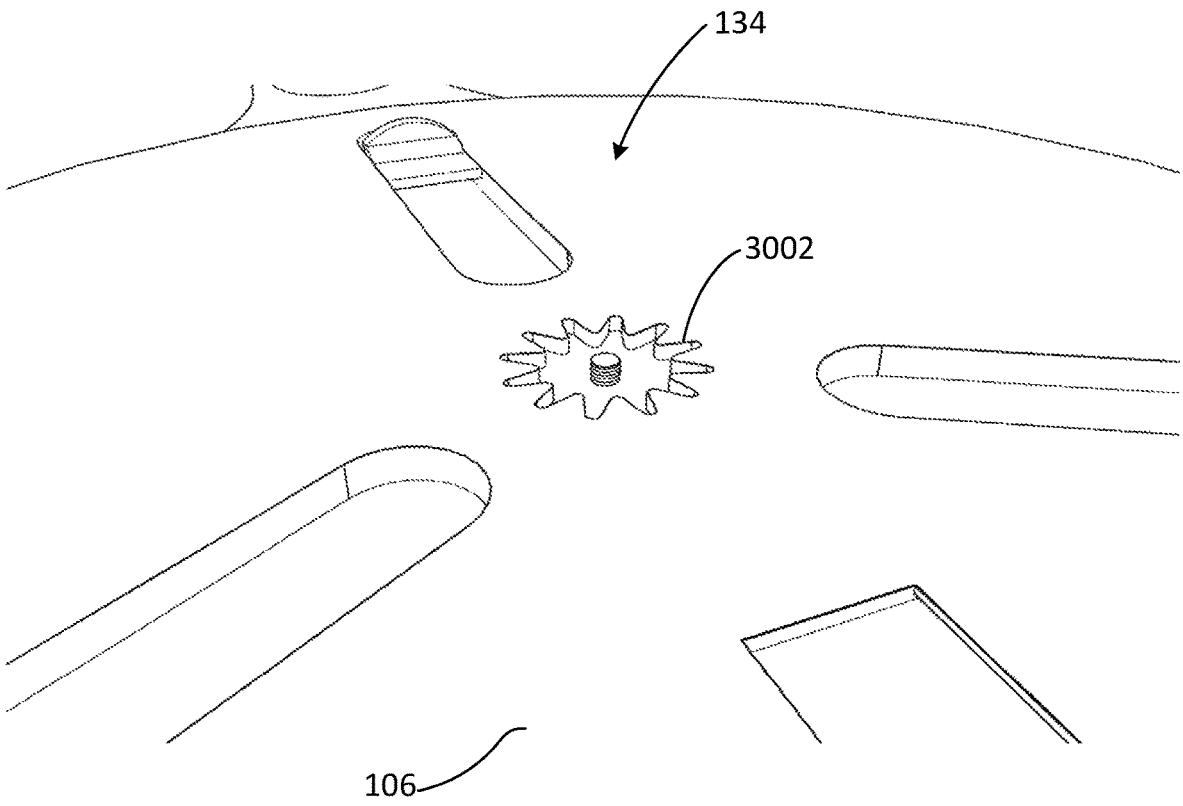
FIG. 30 illustrates a perspective overview of a top surface 134 of said top plate 106.

FIG. 30 illustrates a perspective overview of said top surface 134 of said top plate 106.

In one embodiment, said top plate 106 can comprise a gear aperture 3002 configured to receive a portion of said drive assembly 2502, as illustrated.

Figure 31:
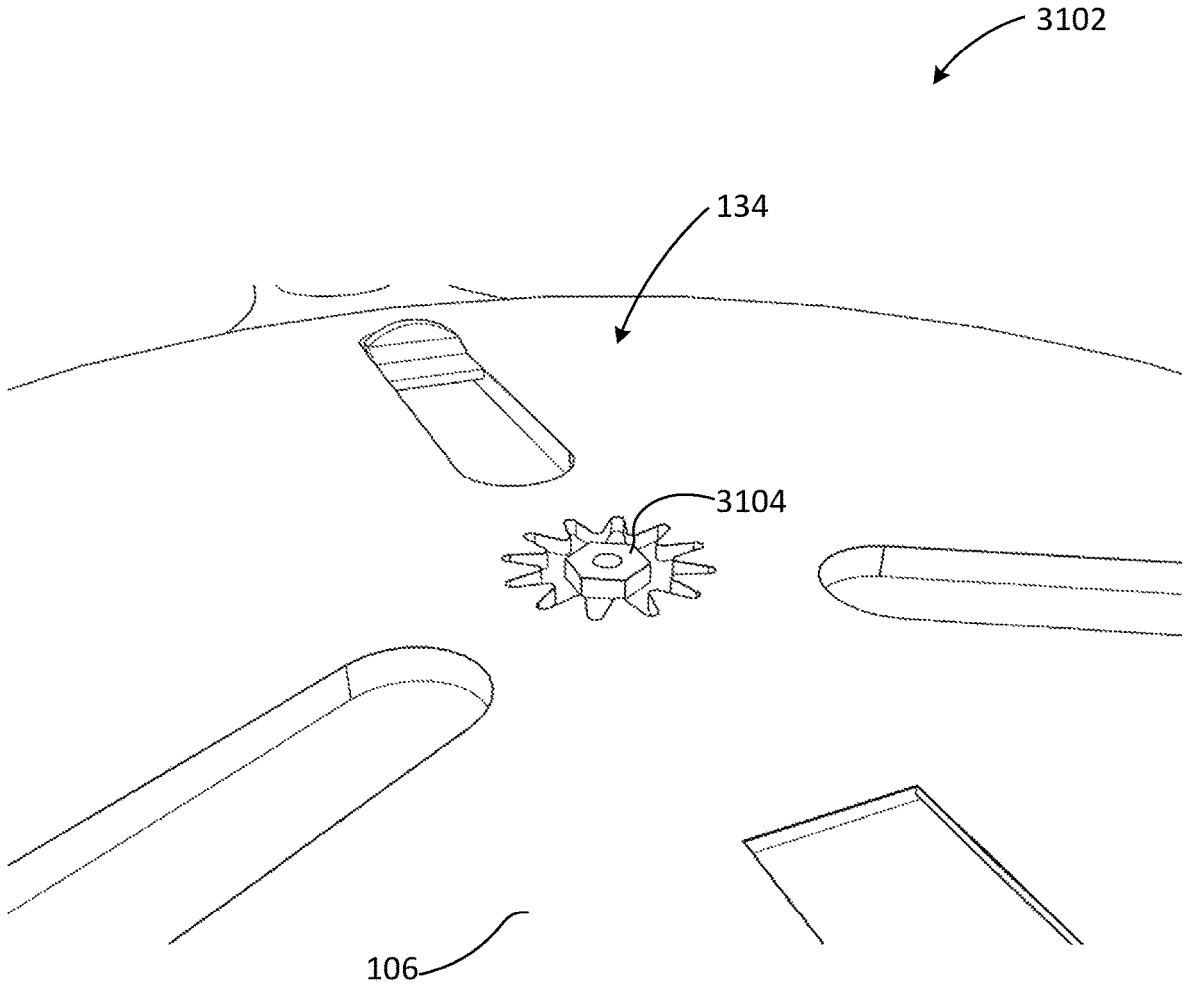
FIG. 31 illustrates a perspective overview of said top plate 106 with said drive assembly 2502 in a fully assembled configuration 3102.

FIG. 31 illustrates a perspective overview of said top plate 106 with said drive assembly 2502 in a fully assembled configuration 3102.

Said drive assembly 2502 can further comprise a nut 3104 to hold together its parts.

Figure 32:
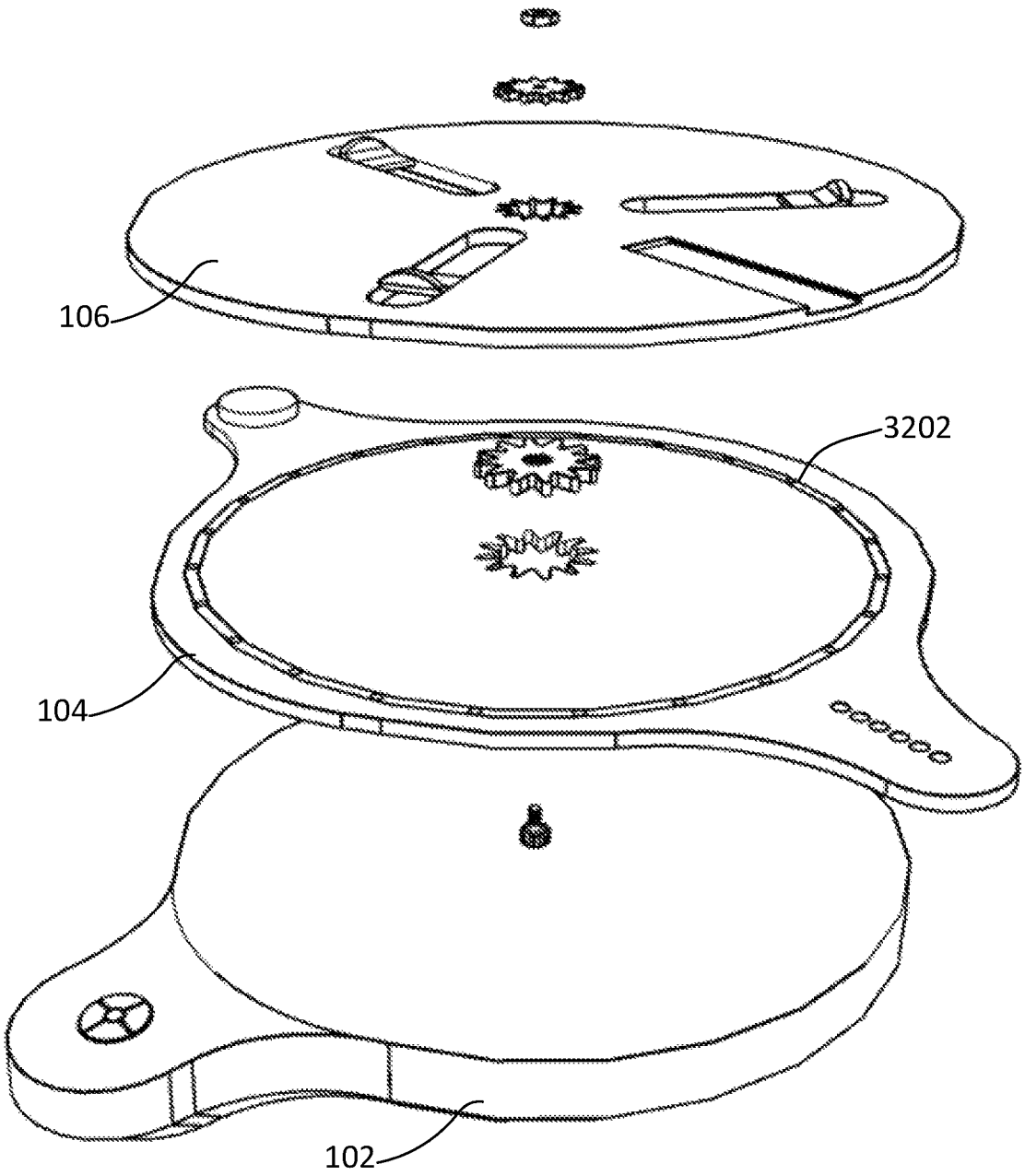
FIG. 32 illustrates a perspective overview of said singing bowl player 100, exploded.

FIG. 32 illustrates a perspective overview of said singing bowl player 100, exploded.

In one embodiment, said rotating layer 104 can comprise a first set of ball bearings 3202 and a second set of ball bearings 3204 on its said bottom surface 304, and said top surface 302, as illustrated.

Figure 33:
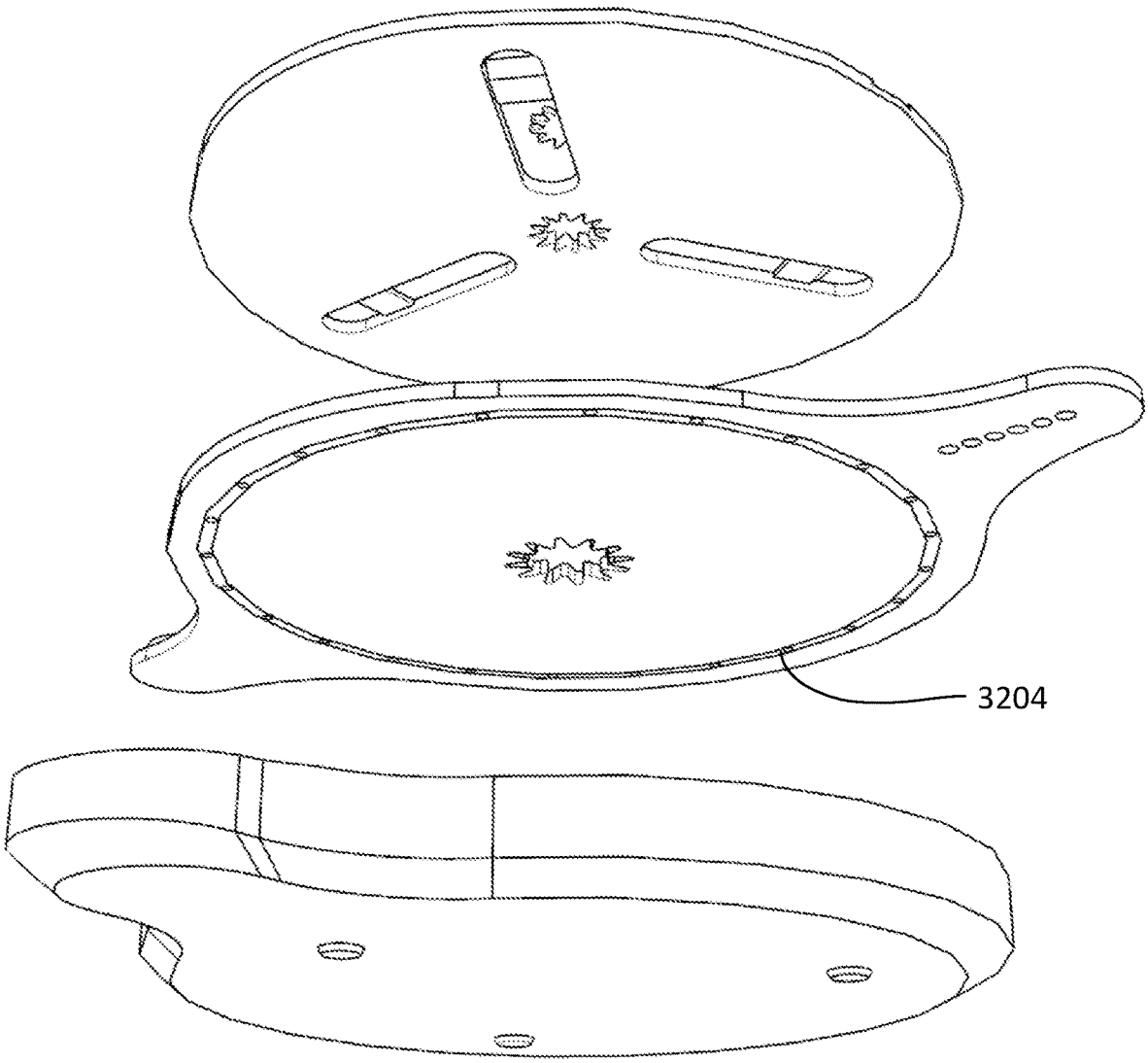
FIG. 33 illustrates a perspective lower of said singing bowl player 100, exploded.

FIG. 33 illustrates a perspective lower of said singing bowl player 100, exploded.

Figure 34A:
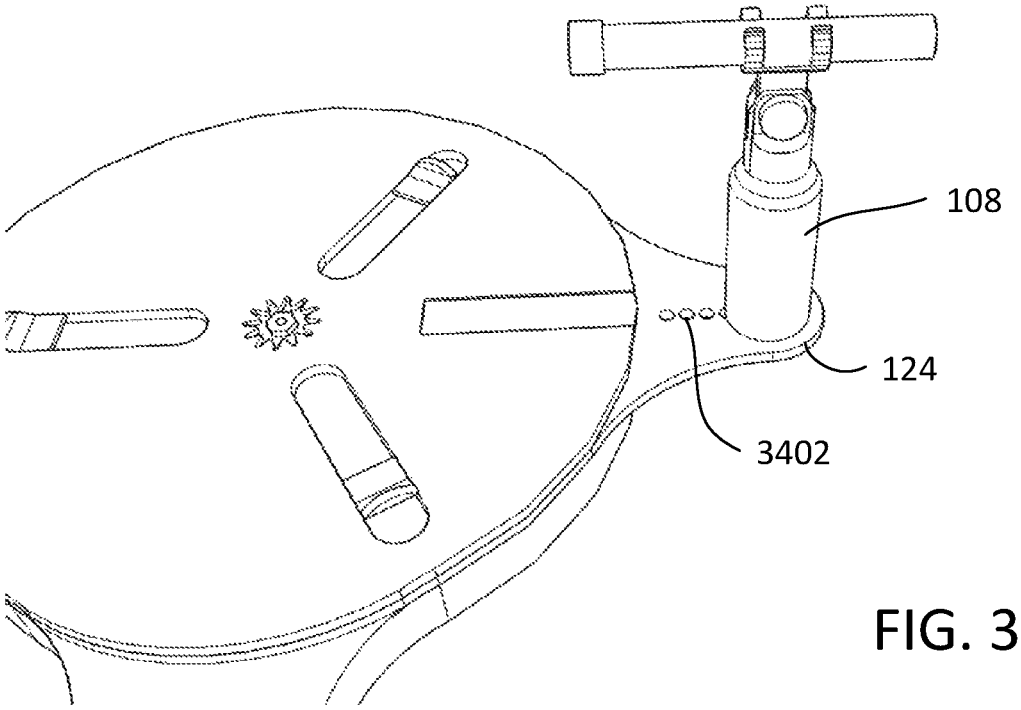
FIGS. 34A and 34B illustrate a perspective overview of said singing bowl player 100.
Figure 34B:
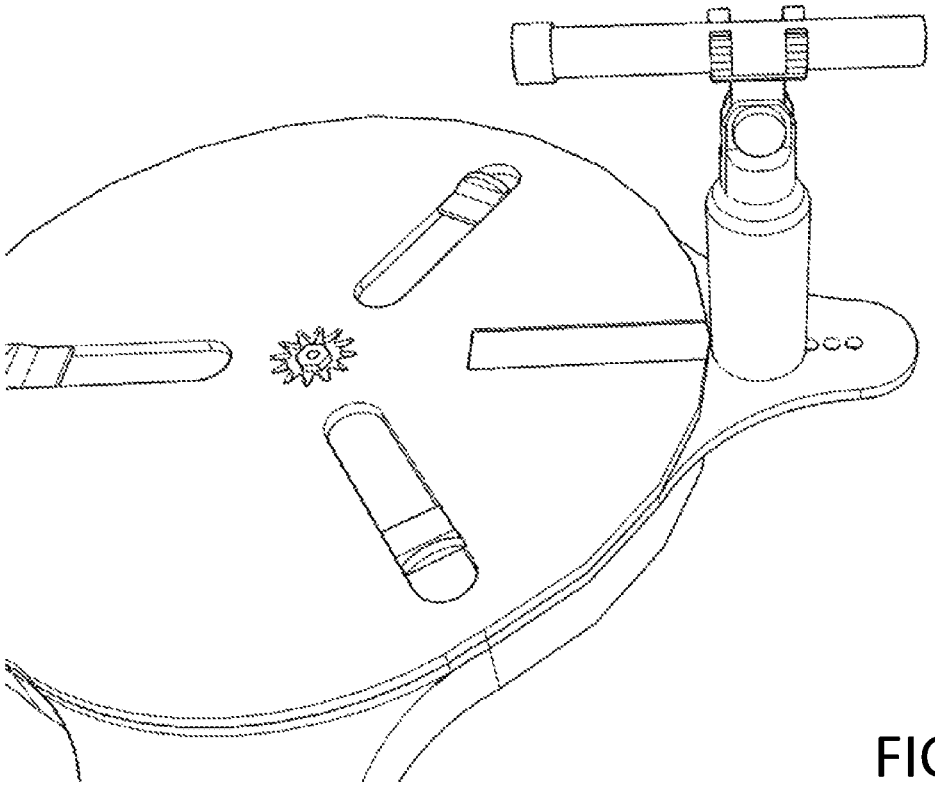

FIGS. 34A and 34B illustrate a perspective overview of said singing bowl player 100.

In one embodiment, said rotating layer 104 at said first extension 124 can comprise a one or more mallet assembly attachment apertures 3402. Said one or more mallet assembly attachment apertures 3402 can be arranged at various distances from said central axis 112. Said one or more mallet assembly attachment apertures 3402 can be configured to securely receive and hold said mallet assembly 108 at various distances from said central axis 112.

Figure 35:
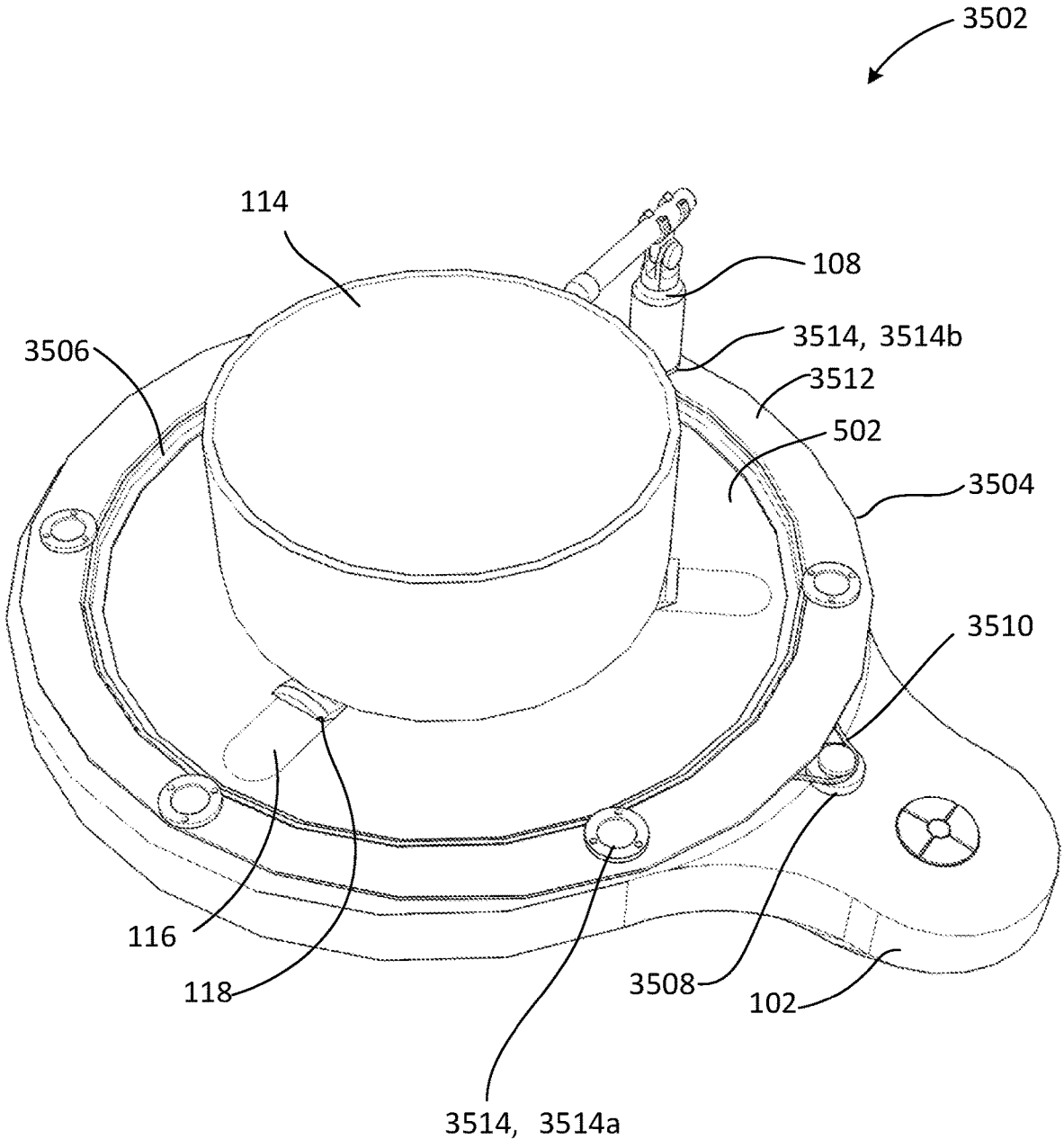
FIG. 35 illustrates a perspective overview of an alternative middle layer configuration 3502.

FIG. 35 illustrates a perspective overview of an alternative middle layer configuration 3502.

In one embodiment, said singing bowl player 100 can comprise a ring rotating layer 3504, a rotating layer guide 3506, a belt drive 3508, and a belt 3510. In one embodiment, said rotating layer guide 3506 can be attached to said top surface 502 of said base 102. In one embodiment, said rotating layer guide 3506 can rotate around said ring rotating layer 3504. In one embodiment, said ring rotating layer 3504 can comprise a top surface 3512 having a plurality of attachment points 3514 (such as second attachment point 3514*b*, first attachment point 3514*a*, and so on). In one embodiment, said mallet assembly 108 selectively attaches to one or more of said plurality of attachment points 3514. In one embodiment, said plurality of bowl supports 118, and said plurality of support slots 116 are embedded into said top surface 502 of said base 102, as illustrated.

Figure 36A:
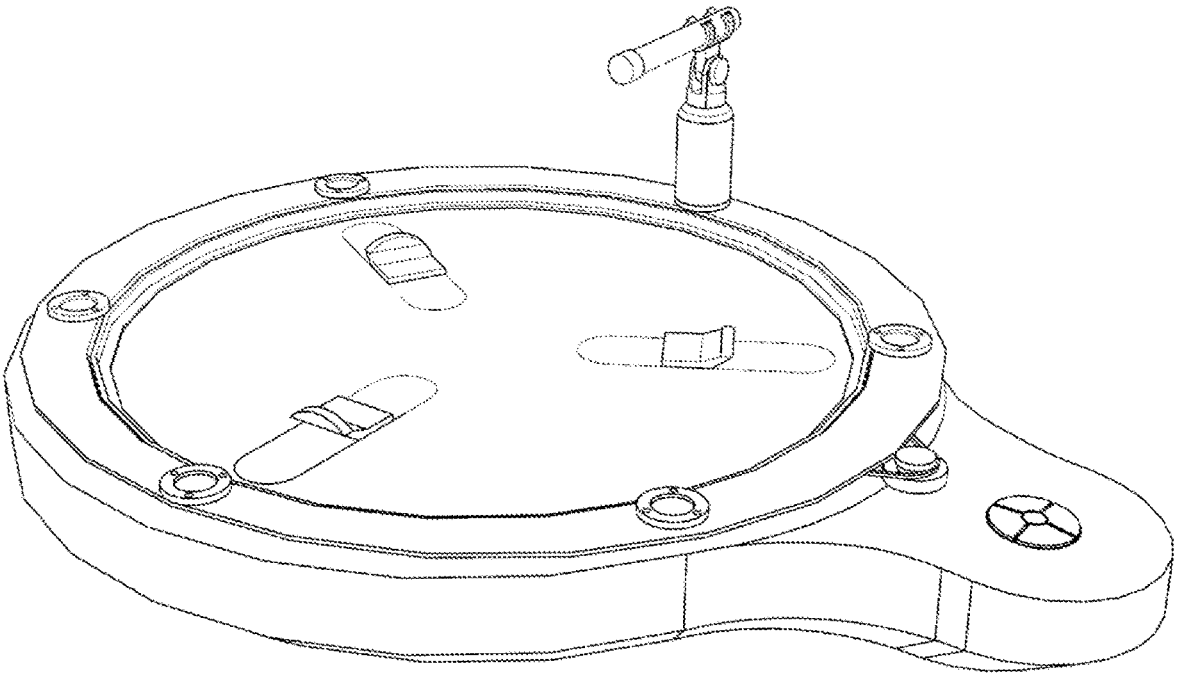
FIGS. 36A and 36B illustrate a perspective overview and detailed view of said singing bowl player 100 and a belt drive 3508, respectively.
Figure 36B:
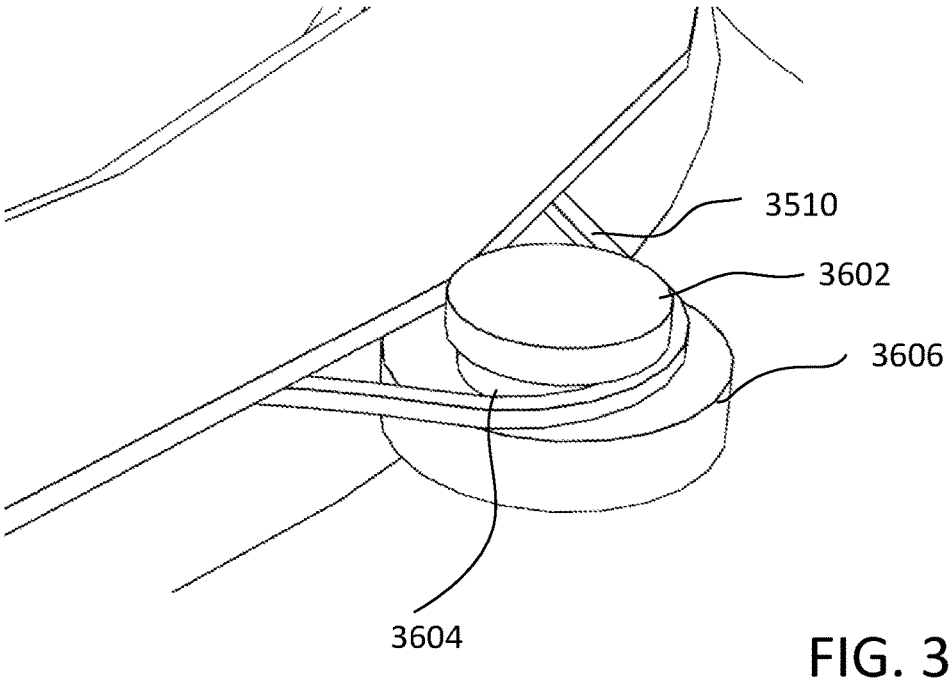

FIGS. 36A and 36B illustrate a perspective overview and detailed view of said singing bowl player 100 and said belt drive 3508, respectively.

In one embodiment, said belt drive 3508 can comprise an upper portion 3602, an indented portion 3604, and a lower portion 3606, as illustrated. In one embodiment, said belt 3510 can be pulled between said lower portion 3606 and said upper portion 3602, and against said indented portion 3604. In one embodiment, said rotary motor 708 can drive said belt drive 3508 which, in turn, can rotate said rotating layer guide 3506 around said ring rotating layer 3504.

Figure 37:
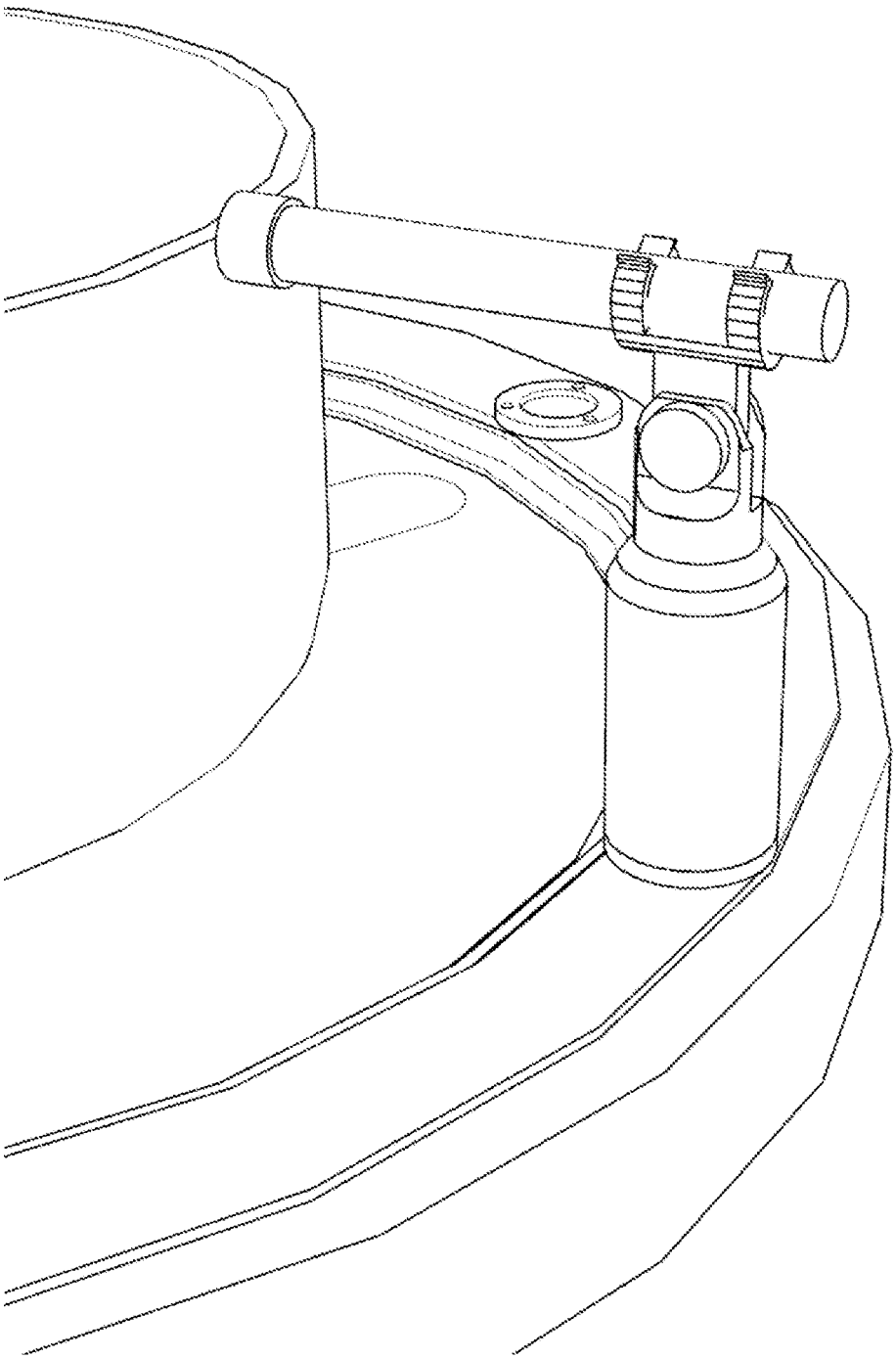
FIG. 37 illustrates a detailed view of said singing bowl player 100.

FIG. 37 illustrates a detailed view of said singing bowl player 100.

Figure 38:
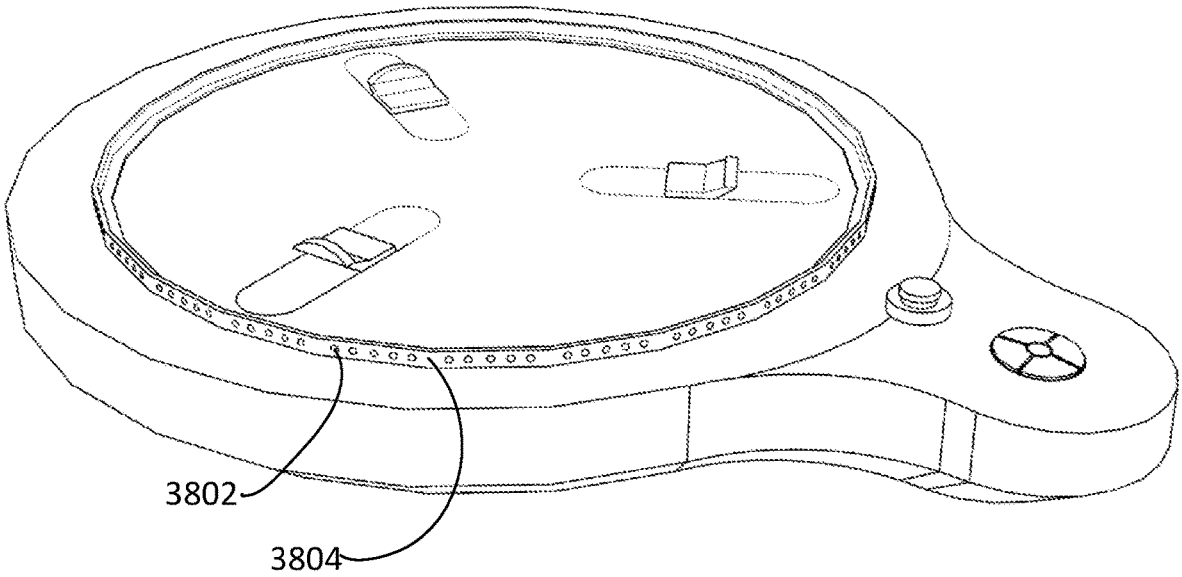
FIG. 38 illustrates a detailed view of said singing bowl player 100 without a ring rotating layer 3504 or a belt 3510.

FIG. 38 illustrates a detailed view of said singing bowl player 100 without said ring rotating layer 3504 or said belt 3510.

In one embodiment, said rotating layer guide 3506 can comprise a plurality of ball bearings 3802 about a guide perimeter 3804; wherein, said plurality of ball bearings 3802 allow said ring rotating layer 3504 to rotated round said rotating layer guide 3506 with minimal friction.

Said plurality of bowl supports 118 comprises said third bowl support 118*c*, said second bowl support 118*b*, and said first bowl support 118*a*.

Said intermittent striker assembly 110.

Said singing bowl player 100 further comprises said top plate 106. Said top plate 106 can be situated above said rotating layer 104. Said rotating layer 104 can be above said base 102. Said top plate 106, said rotating layer 104, and said base 102 can be connected to one another along said central axis 112.

Said rotating layer 104 comprises said second extension 126, said first extension 124, and said substantially round plate 122. Said first extension 124 supports said mallet assembly 108. Said second extension 126 supports said counterweight 132. Said second extension 126, and said first extension 124 extend out beyond the edges of said top plate 106.

Said top plate 106 comprises said top plate diameter 202, said rotating layer 104 comprises said middle plate diameter 306, said base 102 comprise said base diameter 500. Said base diameter 500, said middle plate diameter 306, and said top plate diameter 202 can be substantially identical.

Said singing bowl player 802 for selectively striking, turning and playing said bowl 114. Said singing bowl player 802 comprises said base assembly 804, said vertical assembly 806, said neck assembly 808, said horizontal assembly 810, said striker adjustment assembly 812, and said bowl seat 814. Said base assembly 804 supports said singing bowl player 802. Said vertical assembly 806 connects said base assembly 804 to said neck assembly 808. Said neck assembly 808 connects said vertical assembly 806 to said horizontal assembly 810. Said striker adjustment assembly 812 can be attached to a portion of 108. Said neck assembly 808 comprises said variable height 1002. Said horizontal assembly 810 comprises said variable radius 1004. Said striker adjustment assembly 812 comprises said striker 906. Said striker 906 comprises said tip 908. Said singing bowl player 802 can be configured to place said tip 908 at said striking circumference 1202. Said striking circumference 1202 comprises said variable radius 1004 and said variable height 1010. Said singing bowl player 802 comprises said rotary motor assembly 910 for turning said horizontal assembly 810. turning said horizontal assembly 810 causes said tip 908 to rotate through said striking circumference 1202. Said bowl seat 814 holds a portion of said bowl 114.

The invention claimed is:

1. A singing bowl player for selectively striking, turning and playing a bowl, wherein:

said singing bowl player comprises a central axis, a mallet assembly, a rotating layer, and a base;

said base supports said singing bowl player;

said mallet assembly attaches to said rotating layer;

said rotating layer is configured to rotate about said central axis relative to said base in a 360-degree pattern;

said base supports and secures said bowl;

said mallet assembly comprises a mallet having a striking tip;

said mallet assembly selectively holds said striking tip of said mallet at a rim of said bowl as said rotating layer rotates said striking tip around said rim; said singing bowl player further comprises a top plate;

said top plate is situated above said rotating layer;

said rotating layer is above said base;

said top plate, said rotating layer, and said base are connected to one another along said central axis:

said rotating layer further comprises a drive system placeholder configured to mate with a top plate central aperture of said top plate;

said drive system placeholder, and said top plate central aperture are both aligned with said central axis; and said drive system placeholder and said base to attach to one another and allow said base to transmit a drive force to said top plate through said rotating layer.

2. The singing bowl player of claim 1, wherein:

said singing bowl player further comprises an intermittent striker assembly;

said intermittent striker assembly comprises a striking tip, a hinge, and a vertical striker support assembly; and said intermittent striker assembly is configured to selectively gong said bowl by swinging said striking tip into a portion of said bowl around said hinge.

3. The singing bowl player of claim 2, wherein:

said singing bowl player further comprises said top plate;

said top plate is situated above said rotating layer;

said rotating layer is above said base;

said top plate, said rotating layer, and said base are connected to one another along said central axis; and said intermittent striker assembly is adjustable within an intermittent striker slot to accommodate said bowl having various diameters by moving said intermittent striker assembly in and out relative to said central axis within said intermittent striker slot.

4. The singing bowl player of claim 1, wherein:

said singing bowl player further comprises a plurality of bowl supports; and said plurality of bowl supports surround and center said bowl about said central axis.

5. The singing bowl player of claim 4, wherein:

said singing bowl player further comprises said top plate;

said top plate is situated above said rotating layer;

said rotating layer is above said base;

said top plate, said rotating layer, and said base are connected to one another along said central axis; and said top plate further comprises a plurality of support slots.

6. The singing bowl player of claim 5, wherein:

said plurality of support slots comprise a third support slot, a second support slot, and a first support slot;

said plurality of bowl supports comprise a third bowl support, a second bowl support, and a first bowl support; and said plurality of bowl supports are adjustable within said plurality of support slots to accommodate said bowl having various diameters by moving said plurality of bowl supports in and out relative to said central axis.

7. The singing bowl player of claim 4, wherein:

said plurality of bowl supports comprise rubber feet holding a lower portion of said bowl.

8. The singing bowl player of claim 4, wherein:

said plurality of bowl supports comprises said third bowl support, said second bowl support, and said first bowl support.

9. The singing bowl player of claim 1, wherein:

said singing bowl player further comprises a top plate;

said top plate is situated above said rotating layer;

said rotating layer is above said base; and said top plate, said rotating layer, and said base are connected to one another along said central axis.

10. The singing bowl player of claim 9, wherein:

said rotating layer comprises a second extension, a first extension, and a substantially round plate;

said first extension supports said mallet assembly;

said second extension supports a counterweight; and said second extension, and said first extension extend out beyond a top plate diameter of said top plate.

11. The singing bowl player of claim 9, wherein:

said top plate comprises a top plate diameter, said rotating layer comprises a middle plate diameter, said base comprise a base diameter; and said base diameter, said middle plate diameter, and said top plate diameter are substantially identical.

12. A singing bowl player for selectively striking, turning and playing a bowl, wherein:

said singing bowl player comprises a base assembly, a vertical assembly, a neck assembly, a horizontal assembly, a striker adjustment assembly, and a bowl seat;

said base assembly supports said singing bowl player;

said vertical assembly connects said base assembly to said neck assembly;

said neck assembly connects said vertical assembly to said horizontal assembly;

said striker adjustment assembly is attached to a portion of a mallet assembly;

said neck assembly comprises variable height;

said horizontal assembly comprises a variable radius;

said striker adjustment assembly comprises striker;

said striker comprises a tip;

said singing bowl player is configured to place said tip at a striking circumference;

said striking circumference comprises said variable radius and a variable height;

said singing bowl player comprises a rotary motor assembly for turning said horizontal assembly;

turning said horizontal assembly causes said tip to rotate through said striking circumference; and said bowl seat holds a portion of said bowl.

13. A singing bowl player for selectively striking, turning and playing a bowl, wherein:

said singing bowl player comprises a central axis, a mallet assembly, a rotating layer, and a base;

said base supports said singing bowl player;

said mallet assembly attaches to said rotating layer;

said rotating layer is configured to rotate about said central axis relative to said base in a 360-degree pattern;

said base supports and secures said bowl;

said mallet assembly comprises a mallet having a striking tip;

said mallet assembly selectively holds said striking tip of said mallet at a rim of said bowl as said rotating layer rotates said striking tip around said rim;

said singing bowl player further comprises an intermittent striker assembly;

said intermittent striker assembly comprises a striking tip, a hinge, and a vertical striker support assembly; and said intermittent striker assembly is configured to selectively gong said bowl by swinging said striking tip into a portion of said bowl around said hinge.

14. A singing bowl player for selectively striking, turning and playing a bowl, wherein:

said singing bowl player comprises a central axis, a mallet assembly, a rotating layer, and a base;

said base supports said singing bowl player;

said mallet assembly attaches to said rotating layer;

said rotating layer is configured to rotate about said central axis relative to said base in a 360-degree pattern;

said base supports and secures said bowl;

said mallet assembly comprises a mallet having a striking tip;

said mallet assembly selectively holds said striking tip of said mallet at a rim of said bowl as said rotating layer rotates said striking tip around said rim;

said singing bowl player further comprises a plurality of bowl supports; and said plurality of bowl supports surround and center said bowl about said central axis.

15. A singing bowl player for selectively striking, turning and playing a bowl, wherein:

said singing bowl player comprises a central axis, a mallet assembly, a rotating layer, and a base;

said base supports said singing bowl player;

said mallet assembly attaches to said rotating layer;

said rotating layer is configured to rotate about said central axis relative to said base in a 360-degree pattern;

said base supports and secures said bowl;

said mallet assembly comprises a mallet having a striking tip;

said mallet assembly selectively holds said striking tip of said mallet at a rim of said bowl as said rotating layer rotates said striking tip around said rim;

said singing bowl player further comprises a top plate;

said top plate is situated above said rotating layer;

said rotating layer is above said base; and said top plate, said rotating layer, and said base are connected to one another along said central axis.

16. The singing bowl player of claim 15, wherein:

said rotating layer comprises a second extension, a first extension, and a substantially round plate;

said first extension supports said mallet assembly;

said second extension supports a counterweight; and said second extension and said first extension extend out beyond a top plate diameter of said top plate.

17. The singing bowl player of claim 15, wherein:

said top plate comprises a top plate diameter, said rotating layer comprises a middle plate diameter, said base comprise a base diameter; and said base diameter, said middle plate diameter, and said top plate diameter are substantially identical.

* * * * *